US010067462B2

(12) United States Patent
Fujii

(10) Patent No.: US 10,067,462 B2
(45) Date of Patent: Sep. 4, 2018

(54) DEVELOPER CONTAINER, DEVELOPER UNIT AND IMAGE FORMING APPARATUS

(71) Applicant: Oki Data Corporation, Tokyo (JP)

(72) Inventor: Masashi Fujii, Tokyo (JP)

(73) Assignee: Oki Data Corporation, Tokyo (JP)

( * ) Notice: Subject to any disclaimer, the term of this patent is extended or adjusted under 35 U.S.C. 154(b) by 8 days.

(21) Appl. No.: 15/464,132

(22) Filed: Mar. 20, 2017

(65) Prior Publication Data

US 2017/0277118 A1 Sep. 28, 2017

(30) Foreign Application Priority Data

Mar. 24, 2016 (JP) ..... 2016-060265

(51) Int. Cl.

| | |
|---|---|
| ***G03G 15/04*** | (2006.01) |
| ***G03G 21/16*** | (2006.01) |
| ***G03G 21/18*** | (2006.01) |
| ***G03G 15/06*** | (2006.01) |
| ***G03G 15/00*** | (2006.01) |
| ***G03G 15/08*** | (2006.01) |

(52) U.S. Cl.

CPC ..... *G03G 21/1652* (2013.01); *G03G 15/06* (2013.01); *G03G 15/0863* (2013.01); *G03G 15/5066* (2013.01); *G03G 21/1875* (2013.01); *G03G 21/1885* (2013.01); *G03G 21/1896* (2013.01); *G03G 2215/0141* (2013.01); *G03G 2215/0697* (2013.01)

(58) Field of Classification Search

CPC ..... G03G 21/1885; G03G 21/1875; G03G 21/1896; G03G 15/0863

See application file for complete search history.

(56) References Cited

U.S. PATENT DOCUMENTS 7,822,371 B2 * 10/2010 Taguchi ..... G03G 15/0863 399/258
2005/0095017 A1 * 5/2005 Kikuchi ..... G03G 21/1889 399/12

FOREIGN PATENT DOCUMENTS

JP 2007-199457 A 8/2007

* cited by examiner

*Primary Examiner* — Ryan Walsh

(74) *Attorney, Agent, or Firm* — Muncy, Geissler, Olds & Lowe, P.C.

(57) ABSTRACT

A developer container includes a memory device with a first marker; and a main body with a second marker, the main body being configured to accommodate a developer. The memory device is attached to the main body such that both the first marker and the second marker are visually recognized.

14 Claims, 19 Drawing Sheets

DEVELOPER CONTAINER, DEVELOPER UNIT AND IMAGE FORMING APPARATUS

CROSS REFERENCE TO RELATED APPLICATION

This application claims priority under 35 USC 119 to Japanese Patent Application No. 2016-060265 filed on Mar. 24, 2016 original document, the entire contents which are incorporated herein by reference.

TECHNICAL FIELD

The present invention relates to a developer container, a development unit, an image carrier unit, an image forming unit, and an image forming apparatus.

BACKGROUND

The applicant has already filed an application for a toner container in which a memory (information holding unit) is held by a frame and an image forming apparatus equipped with the container (for example, see Patent Document 1). The memory is configured to store information (e.g., color) on a toner to be accommodated in the toner container so that communication can be performed between the memory and, for example, a communication device provided in a main body of an image forming apparatus.

RELATED ART

[Patent Doc. 1] JP Laid-Open Patent Publication 2007-199457

However, in the image forming apparatus equipped with the toner container described in the aforementioned Patent Document 1, it was difficult for a user to easily confirm the memory attachment state in a state in which the memory is attached to the frame.

Therefore, it is desirable to provide a developer container, a development unit, an image carrier unit, an image forming unit, and an image forming apparatus in which a user can easily confirm that a memory device is properly attached.

SUMMARY

A developer container, disclosed in the application, includes a memory device with a first marker; and a main body with a second marker, the main body being configured to accommodate a developer. The memory device is attached to the main body such that both the first marker and the second marker are visually recognized.

An image carrier unit, disclosed as one embodiment of the present invention, includes a memory device with a first marker; a housing with a second marker, the housing being configured to accommodate an image carrier, a holding member that is configured to hold the memory device with respect to the housing such that both the first marker and the second marker are visually recognized.

In a developer container, a developer unit, an image carrier unit, an image forming unit and image forming apparatus disclosed as embodiments in the application, the memory device is to be held with respect to the housing or the main body such that both the first marker and the second marker are visually recognized. By visual inspection, the installation state of the memory device is easily determined.

According to the developer container, the developing unit, the image carrier unit, the image forming unit, and the image forming apparatus as an embodiment of the present disclosure, a user can easily confirm that the memory device is properly attached.

DETAILED DESCRIPTION OF THE PREFERRED EMBODIMENT(S)

Hereinafter, embodiments of the present invention will be explained in detail with reference to drawings. The following explanation is one specific example of the present invention and the present invention is not limited to the following embodiments. Also, in the present invention, the arrangement, the dimensions, and the proportions of each constituent element shown in each drawing are not limited to those. The explanation will be done in the following order.

1. Embodiment (Image Forming Apparatus Equipped with Image Forming Unit Having Basic Configuration)
2. Modified Example 1 to 8

1. Embodiment

[Configuration of Image Forming Apparatus]

Figure 1:
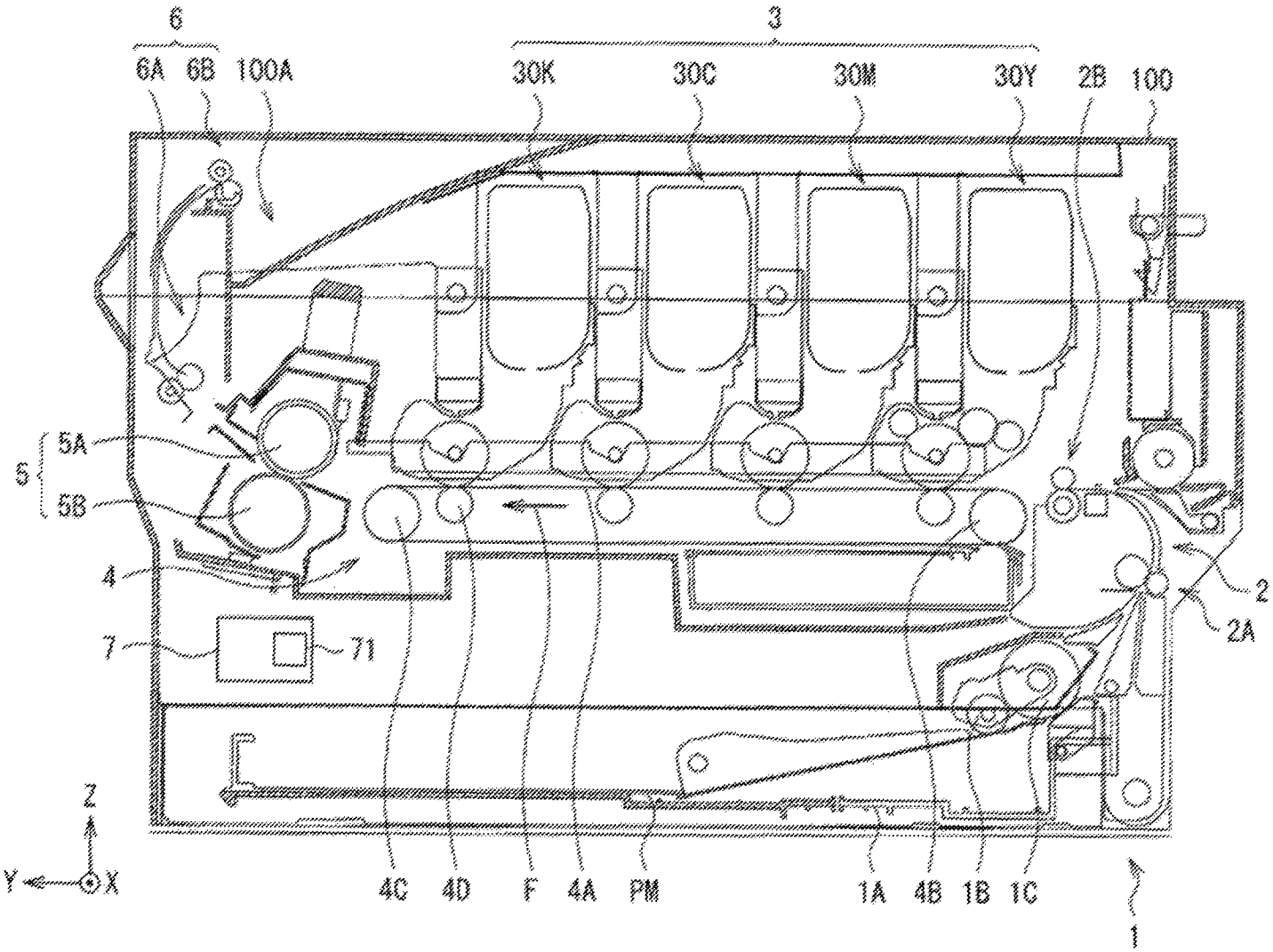
FIG. 1 is a schematic diagram showing an overall configuration example of an image forming apparatus relating to one embodiment of the present invention.

FIG. 1 schematically shows an overall configuration example of an image forming apparatus according to one embodiment of the present invention. The image forming apparatus corresponds to one specific example of an "image forming apparatus" of the present invention, and is a printer for forming an image (e.g., color image) using an electrophotographic system on a medium PM as a print target, such as, e.g., a sheet and a film. The image forming apparatus is equipped with a medium supply part 1, a carrying part 2, an image forming part 3, a transfer part 4, a fuser part 5, an ejection part 6, and a control part 7 in the housing 100. The control part 7 controls the operations of the medium supply part 1, the carrying part 2, image forming part 3, the transfer part 4, the fuser part 5, and the ejection part 6. Further, the control part 7 has a built-in communication part 71, and the communication part 71 is configured to transmit and receive data to and from a memory device 11 (which will be described later) attached to the image forming part 3.

In this specification, a path along which the medium PM is carried is referred to as a carrying path. In the carrying path, a direction toward the medium supply part 1 or a position closer to the medium supply part 1 as viewed from an arbitrary constituent element is referred to as "upstream." In the carrying path, a direction opposite to the direction toward the medium supply part 1 or a position farther from the medium supply part 1 as viewed from an arbitrary constituent element is referred to as "downstream." In the carrying path, the direction along which the medium PM advances (that is, a direction from the upstream side toward the downstream side) is referred to as a carrying direction F. A direction parallel to the medium PM which is carried on the carrying path and orthogonal to the carrying direction F (e.g., X-axis direction of FIG. 1) is referred to as a width direction. The dimension in the carrying direction F is referred to as a length and the dimension in the width direction is referred to as a width.

(Medium Supply Part 1)

The medium supply part 1 is configured to supply a medium PM to the carrying part 2 one by one. The medium supply part 1 is provided with, for example, a cassette 1A, a pickup roller 1B, and a feed roller 1C. In the cassette 1A, a plurality of mediums PM are accommodated in a stacked manner. The cassette 1A is, for example, detachably attached to the lower part of the image forming apparatus. The pickup roller 1B and the feed roller 1C function to sequentially feed the medium PM accommodated in the cassette 1A to the carrying path leading to the carrying part 2. The pickup roller 1B and the feed roller 1C operate so as to rotate in the direction in which the medium PM is fed toward the downstream side carrying part 2 while being controlled by the control part 7. The pickup roller 1B is arranged at a position at which the roller can come into contact with the upper surface of the uppermost medium PM. The feed roller 1C is arranged on the downstream side of the pickup roller 1B.

(Carrying Part 2)

The carrying part 2 is configured to carry the medium PM from the medium supply part 1 to the transfer part 4 while regulating the skew. The carrying part 2, for example, includes two registration roller pairs 2A and 2B.

(Image Forming Part 3)

The image forming part 3 is configured to form a toner image IMG on the medium PM carried from the carrying part 2 (see later described FIG. 2). The image forming part 3 includes, for example, as shown in FIG. 1, four image forming units 30Y, 30M, 30C, and 30K. The image forming units 30Y, 30M, 30C, and 30K form a toner image (images) IMG of each color using each of the corresponding toners T of each of the colors, that is, yellow toner, magenta toner, cyan toner, and black toner. The image forming units 30 are arranged in the order of, for example, the image forming unit 30Y, the image forming unit 30M, the image forming unit 30C, the image forming unit 30K along the carrying direction F. In this specification, the four image forming units 30Y, 30M, 30C, and 30K are collectively referred to as an image forming unit 30 when they are not distinguished.

Figure 2:
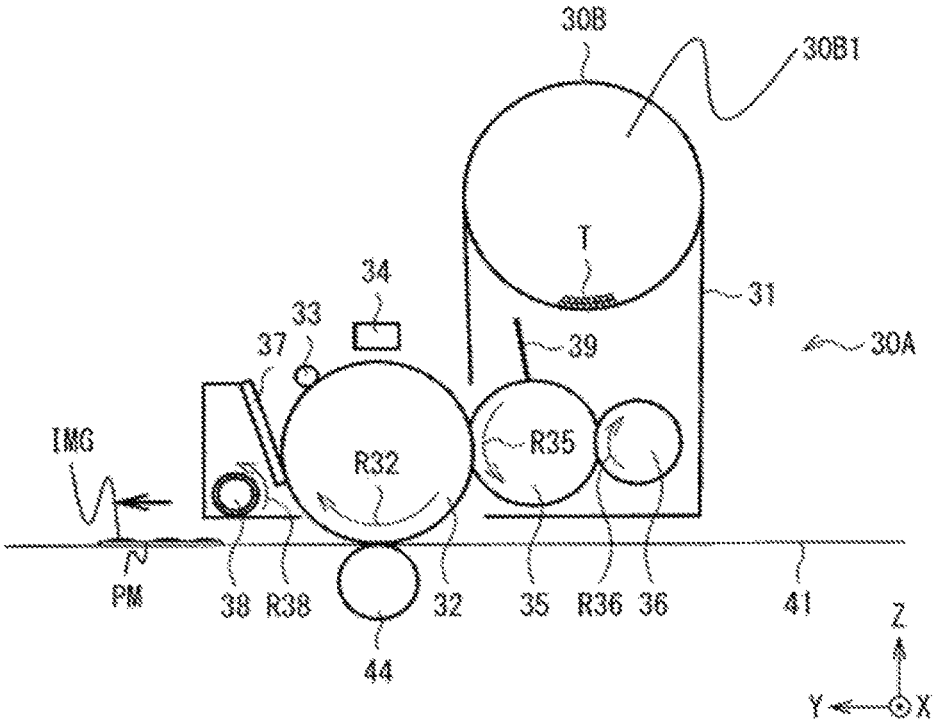
FIG. 2 is a schematic diagram showing an internal configuration of an image forming unit shown in FIG. 1.

FIG. 2 shows the internal configuration of the image forming unit 30. Further, FIG. 2 also shows a constituent element (transfer roller 4D), which is a part of the transfer part 4. The main body part 30A includes a housing 31, a photosensitive drum 32 (or an image carrier) surrounded by the housing 31, a charge roller 33, a development roller 35, a supply roller 36, a cleaning blade 37, a waste toner carrying spiral 38, a doctor blade 39, and an LED (Light Emitting Diode) head 34 provided in a manner such that it can expose the photosensitive drum 32 from the outside of the housing 31. Further, the toner cartridge 30B includes a toner accommodation chamber 30B1 for accommodating a toner T. The details of the image forming unit 30 will be described later.

Figure 3A:
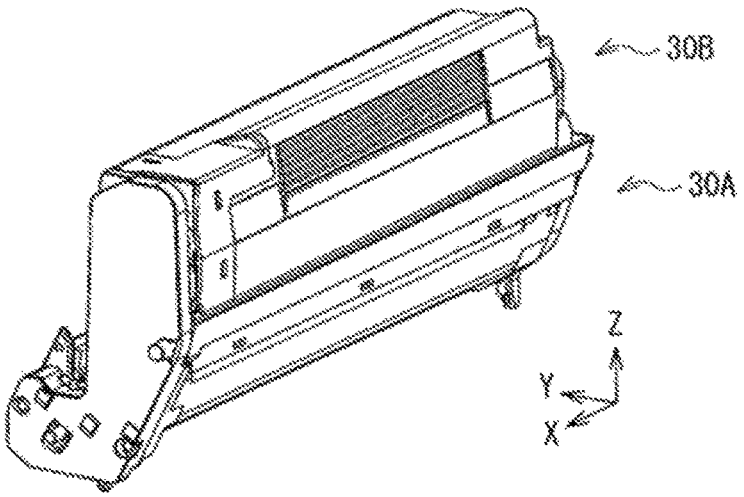
FIG. 3A is a perspective view showing an external appearance of the image forming unit shown in FIG. 1.
Figure 3B:
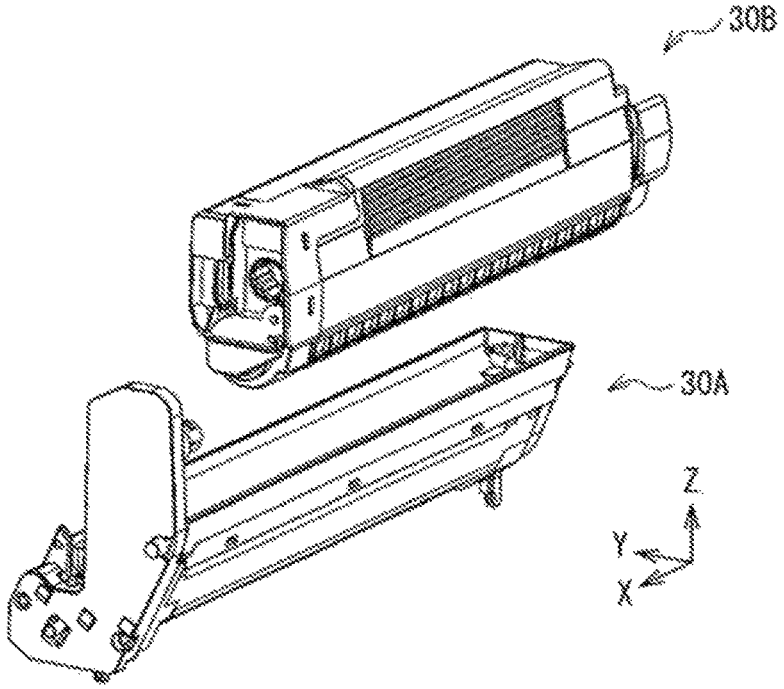
FIG. 3B is an exploded perspective view showing an external appearance of the image forming unit shown in FIG. 1.

Each of the image forming units 30 includes, as shown in FIG. 3A, for example, a main body part 30A and a toner cartridge 30B attached to the upper side of the main body part 30A. The toner cartridge 30B is, as shown in FIG. 3B, for example, separated from the main body part 30A arranged below, and is constituted so as to be detachable from the main body part 30A. FIG. 3A is a perspective view of the image forming unit 30 shown in an enlarged manner, and shows a state in which the toner cartridge 30B is attached to the main body part 30A. On the other hand, FIG. 3B is an exploded perspective view of the image forming unit 30 showing a state in which the toner cartridge 30B is detached from the main body part 30A. It should be noted that each image forming unit 30 is not limited to a configuration in which the main body part 30A and the toner cartridge 30B are detachable, and can be configured such that the main body part 30A and the toner cartridge 30B are integrated.

Here, the image forming units 30 correspond to one specific example of the "image forming unit" of the present invention and the toner T corresponds to one specific example of the "developer" of the present invention. Further, in cases where the main body part 30A and the toner cartridge 30B are integrally formed, the development roller 35, the supply roller 36, and the toner cartridge 30B of the image forming unit 30 correspond to one specific example of a constituent element of the "development unit" of the present invention. The "development unit" is a development device for forming a developer image (toner image IMG) on the surface of the photosensitive drum 32. Further, the photosensitive drum 32, the charge roller 33, and the cleaning blade 37 of the image forming unit 30 correspond to one specific example of the constituent elements of the "image carrier unit" of the present invention. The "image carrier unit" carries a developer image (toner image IMG) on the surface of the photosensitive drum 32 and is also referred to as a drum unit.

(Transfer Part 4)

The transfer part 4 is also referred to as a transfer belt unit. The transfer part 4 includes a transfer belt 4A, a drive roller 4B for driving the transfer belt 4A, an idler roller 4C driven by the drive roller 4B, and a transfer roller 4D arranged so as to sandwich the transfer belt 4A and face the photosensitive drum 32. The drive roller 4B and the idler roller 4C each are an approximately cylindrical member rotatable about a rotational shaft extending in the width direction W. The transfer part 4 is a mechanism for carrying the medium PM carried from the carrying part 2 along the carrying direction F and sequentially transferring the toner image IMG formed by the image forming units 30Y, 30M, 30C, and 30K to the surface of the medium PM.

The transfer belt 4A is, for example, an endless elastic belt made of a resin material such as, e.g., a polyimide resin. The transfer belt 4A is extended (stretched) by the drive roller 4B and the idler roller 4C. The drive roller 4B is rotatably driven in the direction in which the medium PM is carried in the carrying direction F and rotates the transfer belt 4A circularly while being controlled by the control part 7. The drive roller 4B is arranged on the upstream side of the image forming units 30Y, 30M, 30C, and 30K. The idler roller 4C adjusts the tension applied to the transfer belt 4A by bias force from a bias member. The idler roller 4C is configured to rotate in the same direction as the drive roller 4B and arranged on the downstream side of the image forming units 30Y, 30M, 30C and 30K.

The transfer roller 4D is a member for carrying the medium PM along the carrying direction F by rotating in the opposite direction of the photosensitive drum 32 and electrostatically transferring the toner image formed in the image forming units 30Y, 30M, 30C, and 30K to the medium PM. The transfer roller 4D is constituted by, for example, a foaming semiconductive elastic rubber material.

(Fuser Part 5)

The fuser part 5 is a member for fusing the toner image on the medium PM by applying heat and pressure to the toner image transferred on the medium PM which has passed through the transfer part 4. The fuser part 5 is configured so as to include, for example, an upper roller 5A and a lower roller 5B.

The upper roller 5A and the lower roller 5B are each configured so as to include a heat source which is a heater, such as, e.g., a halogen lamp, inside, and function as heat application rollers for applying heat to the toner image on the medium PM. The upper roller 5A rotates in the direction in which the medium PM is carried in the carrying direction F by being controlled by the control part 7. The heat source of the upper roller 5A and the lower roller 5B receives the supply of a bias voltage controlled by the control part 7 and controls the surface temperatures of the upper roller 5A and the lower roller 5B. The lower roller 5B is arranged so as to face the upper roller 5A in a manner such that a press-contacted part is formed between the lower roller 5B and the upper roller 5A, and functions as a pressure application roller for applying a pressure to the toner image on the medium PM. The lower roller 5B is preferably provided with a surface layer made of an elastic body material.

(Ejection Part 6)

The ejection part 6 ejects the medium PM on which a toner image was fused by the fuser part 5 to the outside. The ejection part 6 is provided with, for example, carrying rollers 6A and 6B. The carrying rollers 6A and 6B eject the medium PM to the outside via the carrying path, and for example, stock them on an external stacker 100A. The carrying rollers 6A and 6B are configured to rotate in the direction in which the medium PM is carried in the carrying direction F by being controlled by a later explained control part 7.

[Configuration of Image Forming Unit 30]

Next, the detailed configuration of the image forming unit 30 will be explained.

(Configuration of Main Body Part 30A)

The photosensitive drum 32 is a column-shaped member capable of holding an electrostatic latent image on the surface (surface layer portion) and configured using a photosensitive body (e.g., organic photosensitive body). Specifically, the photosensitive drum 32 is provided with a conductive supporting body and a photoreceptive layer (photoconductive layer) covering its outer periphery (surface). The conductive supporting body is constituted by, e.g., a metal pipe made of aluminum. The photoconductive layer has a structure in which, for example, a charge generation layer and a charge transportation layer are laminated in this order. The photosensitive drum 32 is configured to rotate in the direction in which the medium PM is carried in the carrying direction F (direction of the arrow R32) at a predetermined peripheral speed by being controlled by the control part 7.

The charge roller 33 is a member (charge member) for charging the surface layer portion (photoreceptive layer) of the photosensitive drum 32 and arranged so as to be in contact with the surface of the photosensitive drum 32. The charge roller 33 is provided with, for example, a metal shaft and a semiconductive rubber layer (e.g., a semiconductive epichlorohydrin rubber layer) covering the outer periphery (surface) of the metal shaft. The charge roller 33 is configured to rotate, for example, in the same direction of a rotational direction of the photosensitive drum 32 by being controlled by the control part 7.

The LED head 34 is an exposure device for forming an electrostatic latent image in the surface layer portion (photoreceptive layer) of the photosensitive drum 32 by exposing the surface layer portion (photoreceptive layer) of the photosensitive drum 32. The LED head 34 is provided with a plurality of LED light emitting parts aligned in the widthwise direction with respect to the single photosensitive drum 32. Each LED light emitting part is configured so as to include, for example, a light source such as a light emitting diode for emitting irradiation light and a lens array for forming an image on the surface of the photosensitive drum 32 using the irradiation light The development roller 35 is a member for holding the toner T to develop an electrostatic latent image to the surface and arranged so as to be in contact with the surface (peripheral surface) of the photosensitive drum 32. The development roller 35 is provided with, for example, a metal shaft made of stainless steel and a semiconductive urethane rubber layer. The development roller 35 is configured to rotate in a direction opposite to the rotational direction of the photosensitive drum 32 (in the direction of the arrow R35) at a predetermined peripheral speed by being controlled by the control part 7.

The supply roller 36 is a member (supply member) for supplying a toner T to the development roller 35, and it is arranged so as to be in contact with the surface (peripheral surface) of the development roller 35. The supply roller 36 is provided with, for example, a metal shaft made of stainless steel and a foaming silicone rubber layer covering the outer periphery (surface) of the metal shaft. The supply roller 36 is configured to rotate in a direction opposite to the rotational direction of the development roller 35 (in the direction of the arrow R36) by being controlled by the control part.

The cleaning blade 37 is for scraping off the toner T that remains on the surface of the photosensitive drum 32. The cleaning blade 37 is made of, for example, a flexible rubber material or a plastic material.

The waste toner carrying spiral 38 is a member arranged so that, for example, spiral-shaped blades are formed redially around the shaft and rotate in the direction of the arrow R38, for example, by being controlled by the control part. The waste toner carrying spiral 38 functions to carry the toner T scraped by the cleaning blade 37 in the +X direction by rotating.

The doctor blade 39 is a member for regulating the adhesion amount of the toner T adhering to the surface of the development roller 35.

(Configuration of Toner Cartridge 30B)

Figure 4A:
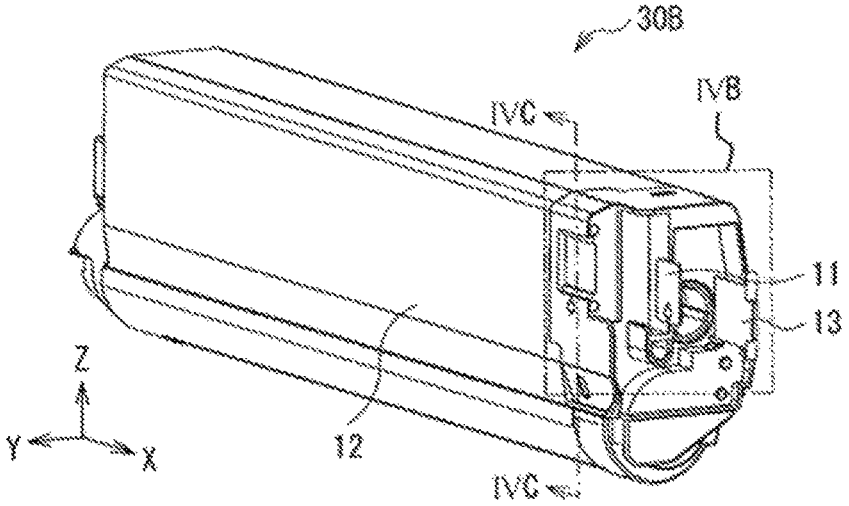
FIG. 4A is another perspective view showing an external appearance of the developer container shown in FIG. 1.
Figure 4B:
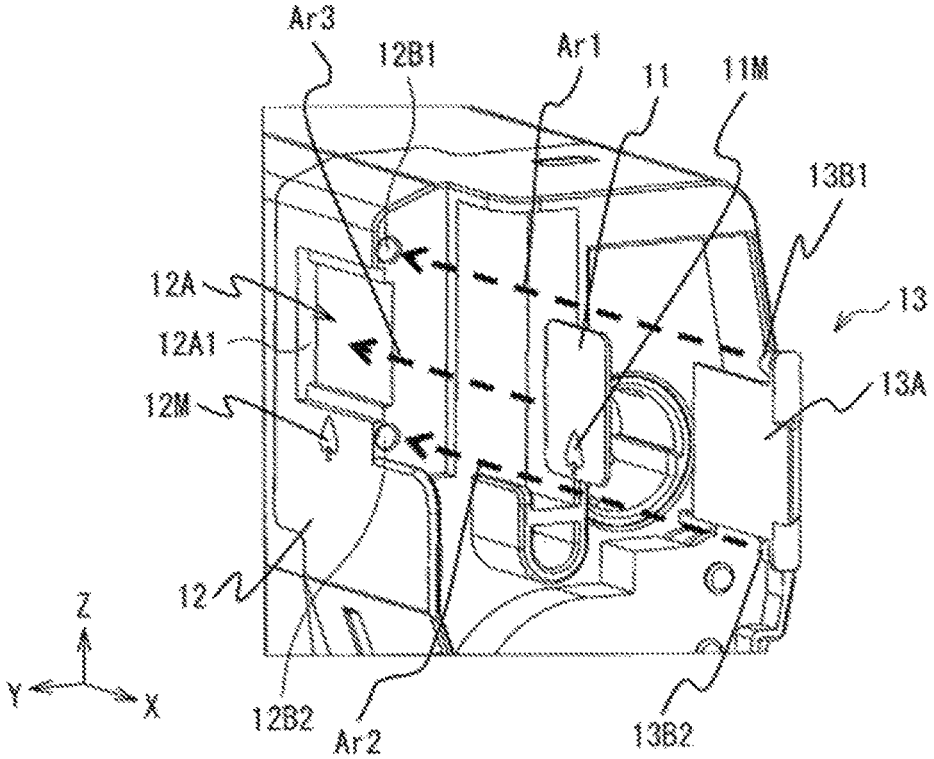
FIG. 4B is an enlarged exploded perspective view showing a main part of the developer container shown in FIG. 4A in an enlarged manner.
Figure 4C:
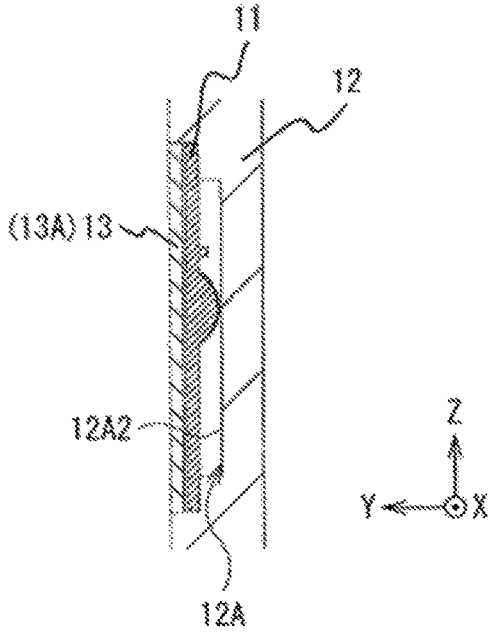
FIG. 4C is a main part enlarged side view showing the main part of the developer container shown in FIG. 4A in an enlarged manner.
Figure 5A:
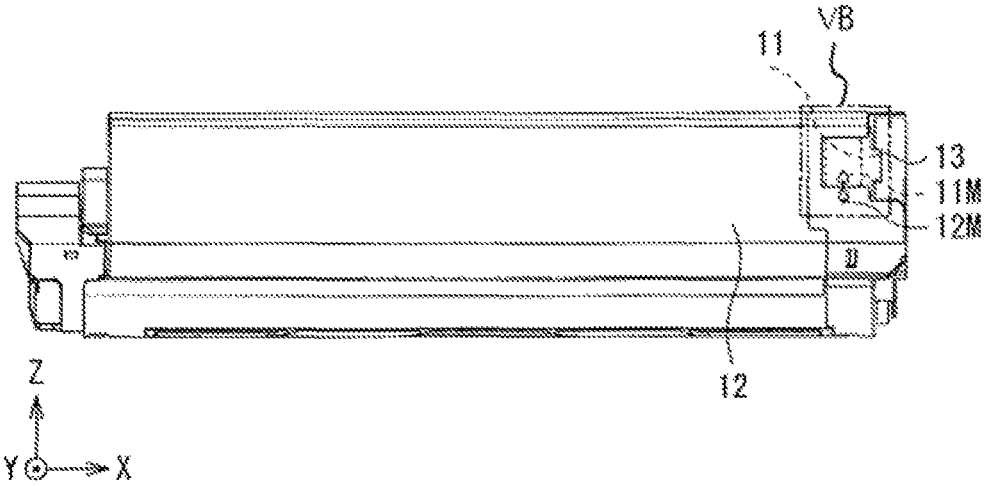
FIG. 5A is a side view showing an external appearance of the developer container shown in FIG. 1.
Figure 5B:
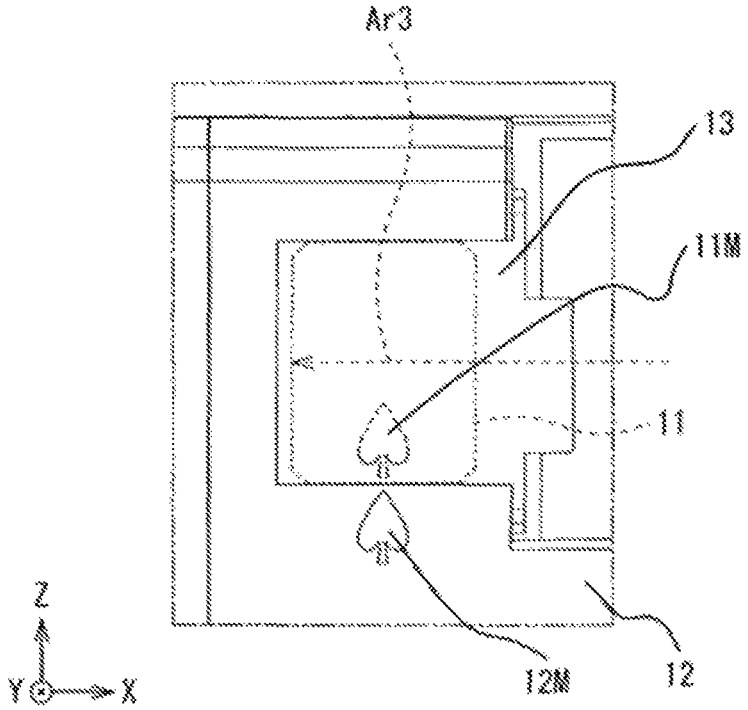
FIG. 5B is a main part enlarged side view showing the main part of the developer container shown in FIG. 5A in an enlarged manner.

Next, the detailed configuration of the toner cartridge 30B will be explained with reference to FIGS. 4A to 4C, FIG. 5A and FIG. 5B. FIG. 4A is an exploded perspective view showing an external appearance of the image forming unit 30 shown in FIG. 3A as viewed from a direction different from FIG. 3A. FIG. 4B is an exploded perspective view showing a region IVB of the toner cartridge 30B shown in FIG. 4A surrounded by a two-dotted chain line in an enlarged manner. FIG. 4C is a cross-sectional view showing the cross-section (Y-Z cross-section) of the toner cartridge 30B in the arrow direction taken along the IVC-IVC line shown in FIG. 4A. FIG. 5A is a side view showing an external appearance of the image forming unit 30 as shown FIG. 3A viewed from the side. FIG. 5B is a side view showing a region VB of the toner cartridge 30B shown in FIG. 5A surrounded by a two-dotted chain line in an enlarged manner.

The toner cartridge 30B includes a memory device 11 as one specific example of the "memory device" of the present invention, a frame 12 as one specific example of the "accommodation member" of the present invention, and a cover 13 as one specific example of the "holding member" of the present invention. Further, for example, the frame 12 and the cover 13 as a unit correspond to one specific example of the "main body" of the present invention.

The memory device 11 is a wireless type ROM (random access read only memory) having, e.g., a memory element and an antenna circuit, and has a flat-shaped external appearance. The memory device 11 is given a marker 11M as one specific example of the "first marker" of the present invention. The memory device 11, as shown in FIG. 4C, for example, is accommodated in the recessed part 12A of the frame 12 (which will be explained later) and sandwiched between the cover 13 and the recessed part 12A.

The frame 12 has a hollow configuration and a toner accommodation chamber 30B1 (see FIG. 2) for accommodating a toner T is provided therein. In the toner accommodation chamber 30B1, the aforementioned toner T of each color before use is accommodated. A yellow toner is accommodated in the toner accommodation chamber 30B1 of the image forming unit 30Y. Similarly, a magenta toner is accommodated in the toner accommodation chamber 30B1 of the image forming unit 30M, a cyan toner is accommodated in the toner accommodation chamber 30B1 of the image forming unit 30C, and a black toner is accommodated in the toner accommodation chamber 30B1 of the image forming unit 30K. Also, a recessed part 12A, to which the memory device 11 is attached, is provided on the external surface of the frame 12. As shown in FIG. 4B, the memory device 11 is attached to the frame 12 by being moved in the direction of the arrow Ar3 (−X direction) and being inserted in the recessed part 12A and detached from the recessed part 12A of the frame 12 by being moved in the opposite direction (+X direction). In the vicinity of the recessed part 12A of the frame 12, a pair of holes 12B1 and 12B2 facing the +X direction is provided. Furthermore, the vicinity of the recessed part 12A on the external surface of the frame 12 is given a marker 12M as one specific example of the "second marker" of the present invention.

The cover 13 is configured to removably hold the memory device 11 to the frame 12. The cover 13 includes a plate part 13A which sandwiches the memory device 11 between the frame 12 and the recessed part 12A, and posts 13B1 and 13B2 protruding in the −X direction so as to face the holes 12B1 and 12B2, for example. As shown in FIG. 4B, the posts 13B1 and 13B2 are configured to proceed in the direction of the arrow Ar1 and Ar2 and be inserted in the holes 12B1 and 12B2. Here, for example, it may be configured such that the outer diameter of each of the posts 13B1 and 13B2 is made slightly larger than the inner diameter of each of the holes 12B1 and 12B2, and the posts 13B1 and 13B2 are press-fitted into the holes 12B1 and 12B2 to fix the cover 13 to the frame 12. It should be noted that the fixing method of the cover 13 to the frame 12 is not limited to the above, and any other methods, such as, e.g., welding, bonding, and fixing with adhesive tapes, can be used.

FIG. 4C, FIG. 5A, and FIG. 5B show a state in which the memory device 11 is correctly attached to the frame 12. In that state, the memory device 11 is attached to the frame 12 so that both the marker 11M and the marker 12M can be visually recognized from the outside. This is because, in the plate part 13A, the portion that overlaps with at least the marker 11M of the memory device 11 is constituted by a transparent material. Specifically, as shown in FIG. 5A and FIG. 5B, in a state in which the memory device 11 is held to the frame 12, the marker 11M and the marker 12M are positioned so as to be adjacent to each other in the Z-axis direction. That is, in the −X direction (+X direction), which is the insertion direction (removal direction) of the memory device 11, the position of the marker 11M and the position of the marker 12M match approximately. Further, in FIG. 5A and FIG. 5B, the cover 13 is made entirely with a transparent material, and a state in which the memory device 11 (marker 11M) can be seen through the transparent plate part 13A is shown with dashed lines. Furthermore, in this embodiment, a case in which the dimension of the marker 11M and the dimension of the marker 12M are essentially the same is exemplified, but they can be different from each other.

[Function/Effects] (A. Basic Operation)

In this image forming apparatus, the toner image is transferred to the medium PM as follows.

When print image data and a print order are input into the control part 7 of the image forming apparatus in a startup state from an external device such as a PC, the control part 7 starts the print operation of the print image data according to the print order.

For example, as shown in FIG. 1, the medium PM accommodated in the cassette 1A is picked up one by one from the uppermost part by the pickup roller 1B and fed to the carrying part 2 on the downstream side while the skew is being corrected by the feed roller 1C. Next, the medium PM is carried to the image forming part 3 by two registration roller pairs 2A and 2B. In the image forming part 3, the toner image IMG is transferred to the medium PM in the following manner.

In the image forming part 3, according to the print order of the control part 7, the toner image IMG of each color is formed by the following electrophotographic process. Specifically, the control part 7 introduces the toner T accommodated in the toner accommodation chamber 30B1 of the toner cartridge 30B to the inside of the housing 31 of the main body part 30A and rotates the photosensitive drum 32 in the arrow R32 direction at a constant speed. As a result, the charge roller 33, the development roller 35, and the supply roller 36 also start the rotation operation in a predetermined direction.

On the other hand, the control part 7 applies a predetermined voltage to the charge roller 33 of each color to uniformly charge the surface of the photosensitive drums 32 of each color. Next, the control part 7 initiates the LED head 34 to irradiate light corresponding to the color component of the print image based on the image signal to the photosensitive drum 32 of each color and forms an electrostatic latent image to the surface of the photosensitive drum 32 of each color.

The toner T is supplied to the development roller 35 via the supply roller 36 and carried to the surface of the development roller 35. The development roller 35 makes the toner T attach to the electrostatic latent image formed on the photosensitive drum 32 to form a toner image IMG. Further, a predetermined voltage is applied to a transfer roller 4D in the transfer part 4, and an electric field occurs between the photosensitive drum 32 and the transfer roller 4D. When a medium PM travels between the photosensitive drum 32 and the transfer roller 4D, a toner image IMG formed on the photosensitive drum 32 is transferred to the medium PM.

After that, the toner image IMG on the medium PM is fused to the medium PM when heat and pressure is applied in the fuser part 5. Finally, the medium PM on which the toner image IMG was fused is ejected to a stacker 100A on the outside of the image forming apparatus by the ejection part 6.

(B. Attachment/Detachment Operation of Toner Cartridge 30B)

Here, the attachment and detachment of the memory device 11 to and from the frame 12 of the toner cartridge 30B in the image forming unit 30 of this embodiment will be explained with reference to FIGS. 4A to 4C, 5A, and 5B.

When attaching the memory device 11 to the frame 12, first, the memory device 11 is slid in the −X direction and inserted into the recessed part 12A (FIG. 4B). At that time, the memory device 11 is pushed in the −X direction until the edge of the memory device 11 comes into contact with the side surface 12A1 of the recessed part 12A. Additionally, the cover 13 is slid in the −X direction and inserted into the recessed part 12A, and the memory device 11 is sandwiched between the cover 13 and the bottom face 12A2 of the recessed part 12A (FIG. 4B). At that time, the posts 13B1 and 13B2 are press-fitted into the holes 12B1 and 12B2, and the cover 13 is fixed to the frame 12. As a result, it is confirmed that the position of the X-axis direction of the marker 11M seen through the plate part 13A, which is a transparent portion, and the position of the marker 12M in the X-axis direction provided on the outer surface of the frame 12 match. Further, when removing the memory device 11 from the frame 12, an opposite operation as the aforementioned attachment operation is performed. That is, by sliding the cover 13 in the +X direction while pulling the posts 13B1 and 13B2 out of the holes 12B1 and 12B2, the cover 13 is removed from the frame 12. Next, the memory device 11 can be similarly slid in the +X direction to remove the memory device 11 from the frame 12.

(C. Operational Advantage of the Image Forming Apparatus)

In this way, in this embodiment, in the toner cartridge 30B, the cover 13 is configured to include a transparent portion (plate part 13A). Therefore, even in a state in which the memory device 11 is attached to the recessed part 12A of the frame 12 and held by the cover 13, a user can visually recognize both the marker 11M of the memory device 11 and the marker 12M of the frame 12 at the same time. Here, when it is successfully visually recognized that, for example, the position of the marker 11M and the position of the marker 12M in the movement direction (X-axis direction) of the memory device 11 essentially match when compared, it can be easily confirmed that the memory device 11 is correctly attached to the frame 12. Therefore, any attachment errors of the memory device 11 (no attachment or incorrect attachment) can be effectively prevented.

2. Modified Example

Although the present invention has been described above with reference to the embodiments, the present invention is not limited to the aforementioned embodiments, and various modifications may be applicable. For example, in the aforementioned embodiment, an image forming apparatus for forming a color image has been described, but the present invention is not limited to this. For example, it may be an image forming apparatus which transfers only a black toner image to form a monochrome image. Further, in the aforementioned embodiment, an image forming apparatus of a primary transfer system (direct transfer system) has been described, but the present invention can also be applied to a secondary transfer system.

Modified Example 1

Figure 6A:
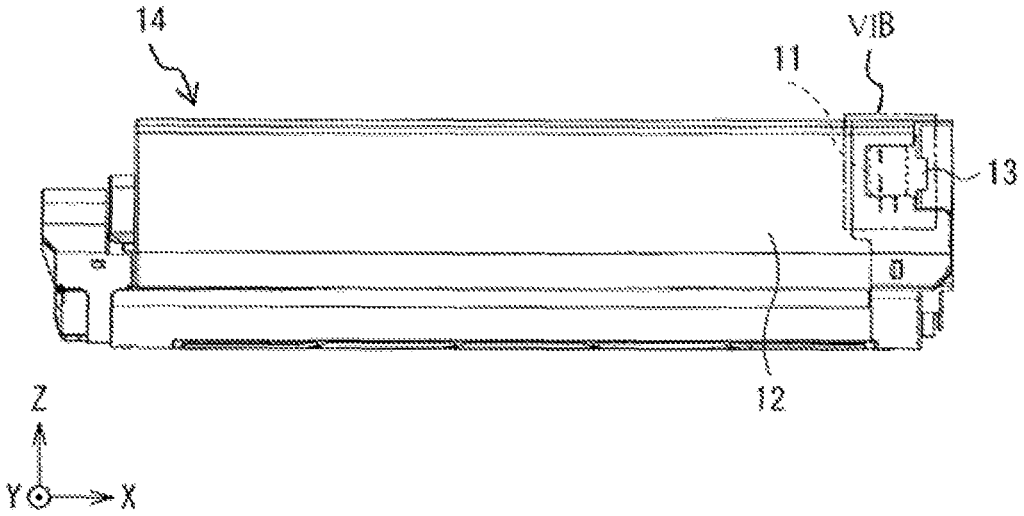
FIG. 6A is a side view showing an external appearance of the developer container as a first modified example.
Figure 6B:
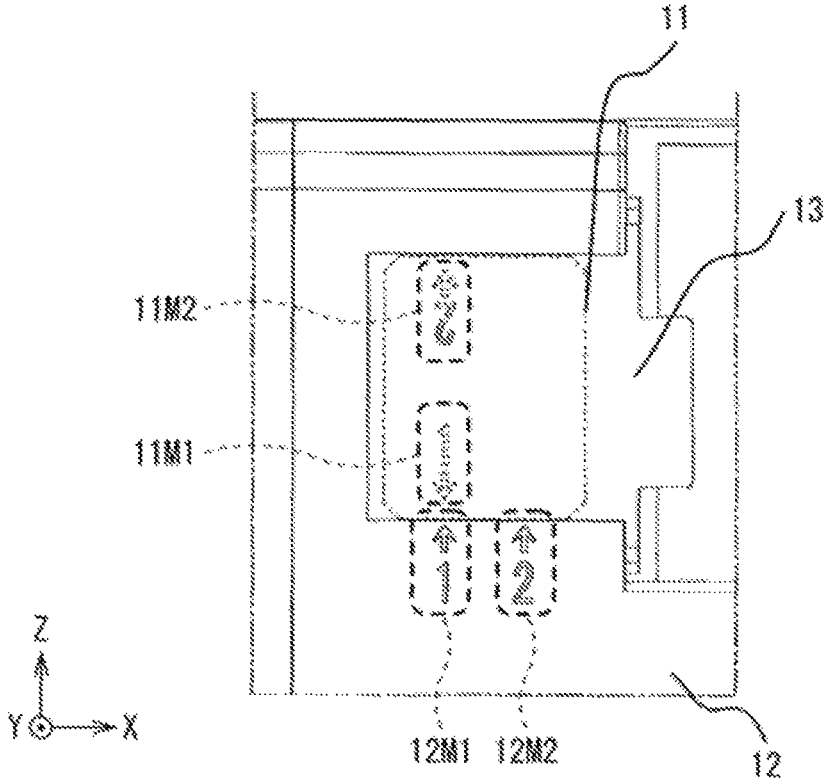
FIG. 6B is a main part enlarged side view showing the main part of the developer container shown in FIG. 6A in an enlarged manner.
Figure 6C:
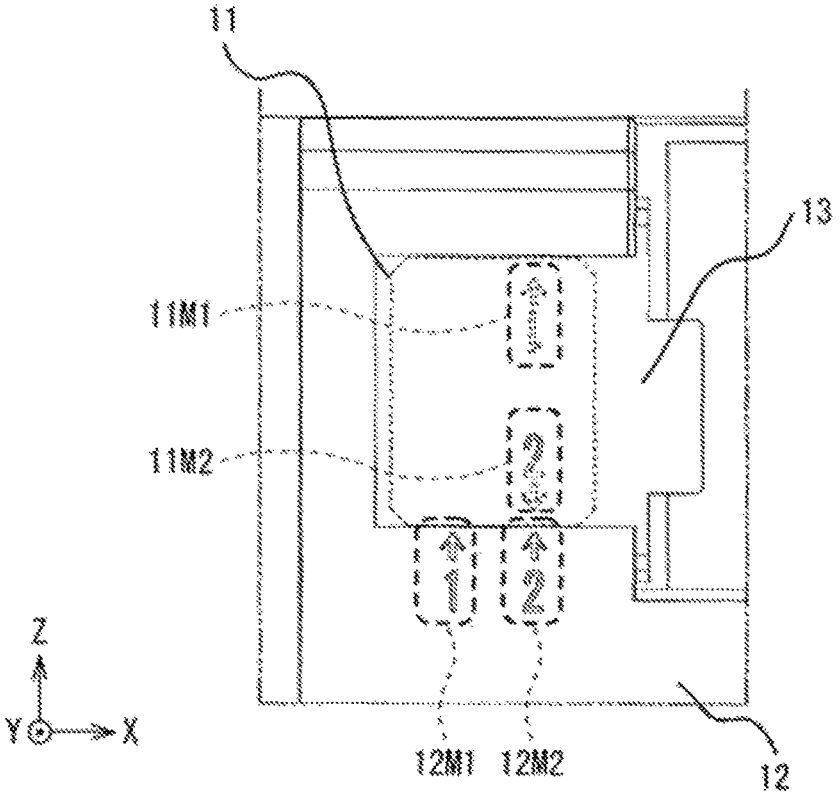
FIG. 6C is another main part enlarged side view showing the main part of the developer container shown in FIG. 6A in an enlarged manner.

FIGS. 6A to 6C show a toner cartridge 14A as a first modified example (Modified Example 1) of the present invention. FIG. 6A is a side view of the external appearance of the toner cartridge 14A, and FIG. 6B is an enlarged side view showing the region VIB surrounded by the two-dotted chain line in the toner cartridge 14A shown in FIG. 6A. FIG. 6C is an enlarged side view showing the region VIB surrounded by the two-dotted chain line in the toner cartridge 14A shown in FIG. 6A. However, the direction of the vertical direction (Z-axis direction) of the memory device 11 in FIG. 6C is opposite to the vertical direction (Z-axis direction) of the memory device 11 in FIG. 6B. That is, the memory device 11 in FIG. 6C is attached in a state in which the memory device 11 in FIG. 6B is rotated by 180° in the X-Z plane. In this Modified Example, two markers 11M1 and 11M2 aligned in the Z-axis direction are provided to the memory device 11. Further, in the frame 12, two markers 12M1 and 12M2 aligned in the X-axis direction are provided. Here, the marker 11M1 is one specific example corresponding to the "first marker" of the present invention, the marker 12M1 is a specific example corresponding to the "second marker" of the present invention, the marker 11M2 is one specific example corresponding to the "third marker" of the present invention, and the marker 12M2 is a specific example corresponding to the "fourth marker" of the present invention.

In the toner cartridge 14A, it is configured to be selected between a first attachment state in which the marker 11M1 and the marker 12M1 are positioned adjacent to each other in the Z-axis direction (see FIG. 6B) and a second attachment state in which the marker 11M2 and the marker 12M2 are positioned adjacent to each other in the Z-axis direction (see FIG. 6C). Specifically, in FIG. 6B, it is in a state in which the marker 11M1 consisting of the number "1" and the downward arrow "↓" is opposed to the marker 12M1 consisting of the numeral "1" and the upward arrow "↑" in the Z-axis direction. This case can be associated with, for example, a case in which the toner cartridge 14A is an initial product. On the other hand, in FIG. 6C, it is in a state in which the marker 11M2 consisting of the number "2" and the downward arrow "↓" is opposed to the marker 12M2 consisting of the numeral "2" and the upward arrow "↑" in the Z-axis direction. In this case, it is possible to associate this case with a case in which, for example, the toner cartridge 14A is a reused product (a toner T filled in again after using the initially filled toner T).

As described above, according to this Modified Example, it is possible for a user to easily determine whether the toner cartridge 14A is an initial product or a reused product by the attachment direction of the memory device 11 with respect to the frame 12.

Modified Example 2

Figure 7A:
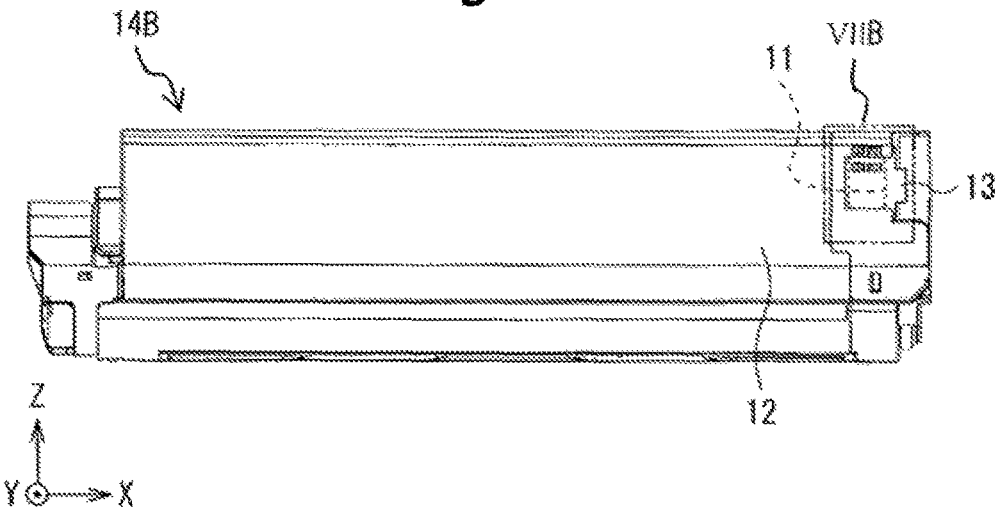
FIG. 7A is a side view showing an external appearance of the developer container as a second modified example.
Figure 7B:
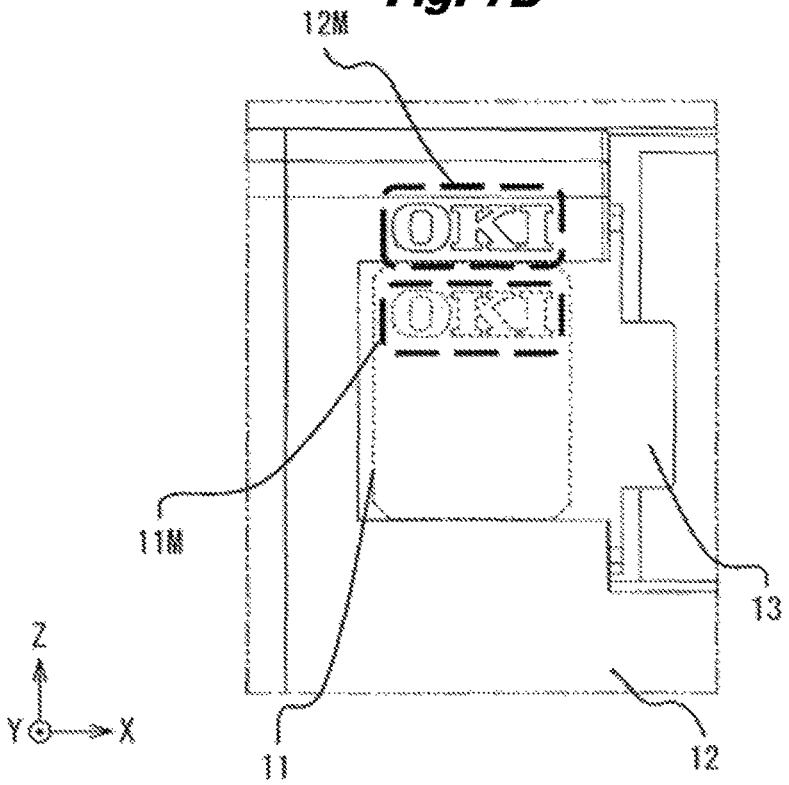
FIG. 7B is a main part enlarged side view showing the main part of the developer container shown in FIG. 7A in an enlarged manner.

FIG. 7A and FIG. 7B show a toner cartridge 14B as a second Modified Example (Modified Example 2) of the present invention. FIG. 7A is a side view showing the external appearance of the toner cartridge 14B, and FIG. 7B is an enlarged side view showing the region VIIB surrounded by the two-dotted chain line in the toner cartridge 14B shown in FIG. 7A. In this modified example, the memory device 11 is provided with a marker 11M consisting of a character string arranged in the X-axis direction. The frame 12 is provided with a marker 12M which is aligned in the X-axis direction and is the same character string as the marker 11M. In this Modified Example, it is easy for a user to visually recognize that the character string of the marker 11M and the character string of the marker 12M are arranged in the Z-axis direction and the positions of corresponding character strings in the X-axis direction are coincided. Therefore, the same effects as those of the toner cartridge 30B of the aforementioned modified examples can be obtained. The character strings of the markers 11M and 12M are not limited to those shown in FIGS. 7A and 7B. Specifically, in addition to the name of the manufacturer or seller, a symbol indicating the type of the image forming unit 30, for example, "TC1010B" or "TC2250Y" may be provided. When such symbols representing the types are provided as markers 11M and 12M, it becomes easy for a user, etc., to confirm that the toner T suitable for the image forming unit 30 is properly attached.

Modified Example 3

Figure 8A:
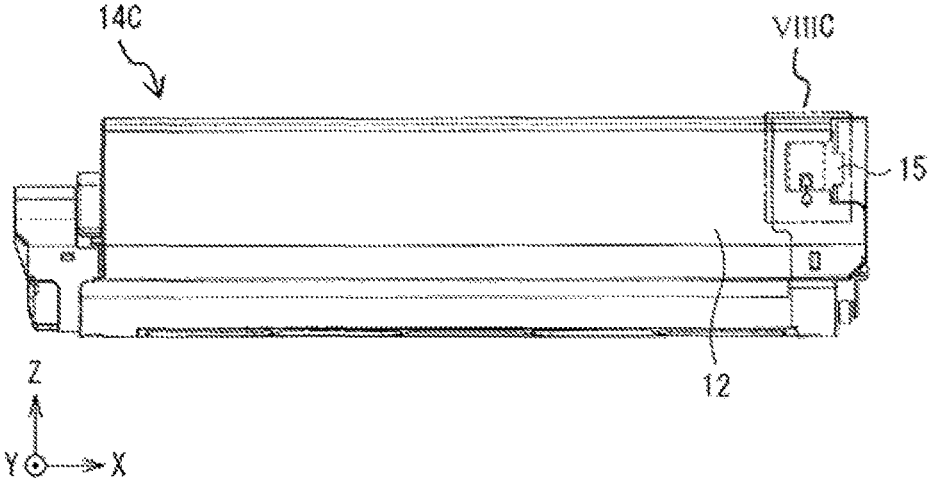
FIG. 8A is a side view showing an external appearance of the developer container as a third modified example.
Figure 8B:
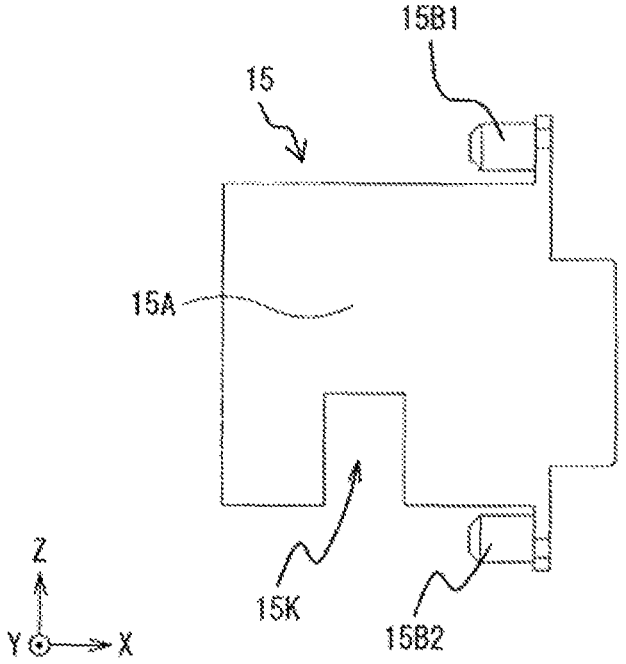
FIG. 8B is a plan view showing a holding member as shown in FIG. 8A.
Figure 8C:
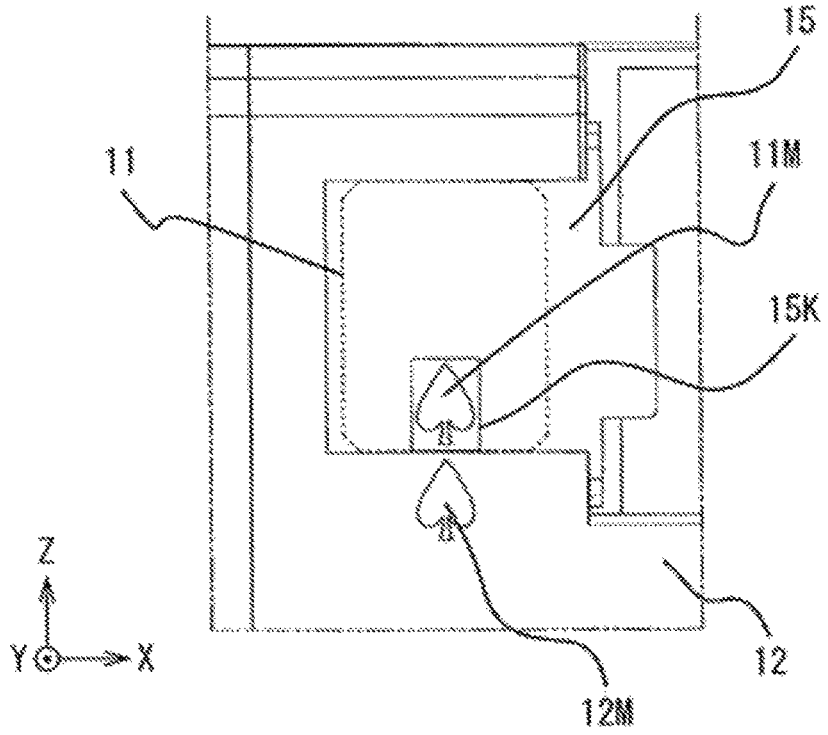
FIG. 8C is a main part enlarged side view showing the main part of the developer container shown in FIG. 8A in an enlarged manner.

FIG. 8A shows a toner cartridge 14C as a third modified example (Modified Example 3) of the present invention. FIG. 8A is a side view showing the external appearance of the toner cartridge 14C. FIG. 8B is a plan view showing the external appearance of a cover 15 used for the toner cartridge 14C shown in FIG. 8A. Further, FIG. 8C is an enlarged side view showing the region VIIIC surrounded by the two-dotted chain line in the toner cartridge 14C shown in FIG. 8A. This Modified Example has substantially the same configuration as the toner cartridge 30B of the aforementioned modified examples except that the cover 15 is mounted instead of the cover 13. The cover 15 includes a plate part 15A made of an opaque material and a cutout 15K provided at a part of the plate part 15A. The cover 15 is further provided with posts 15B1 and 15B2 to be inserted in the holes 12B1 and 12B2, respectively. FIG. 8A show a state in which the memory device 11 is correctly attached to the frame 12 and held by the cover 15. In this state, both the marker 11M and the marker 12M can be visually recognized from the outside with respect to the frame 12. This is because the cutout 15K is formed in a part of the plate part 15A of the cover 15 overlapping with the marker 11M of the memory device 11. Therefore, also in this Modified Example, the same effects as those of the toner cartridge 30B of the aforementioned modified examples can be obtained. It should be noted that the shape of the cutout 15K is not limited to those shown in FIGS. 8A and 8B.

Modified Example 4

Figure 9A:
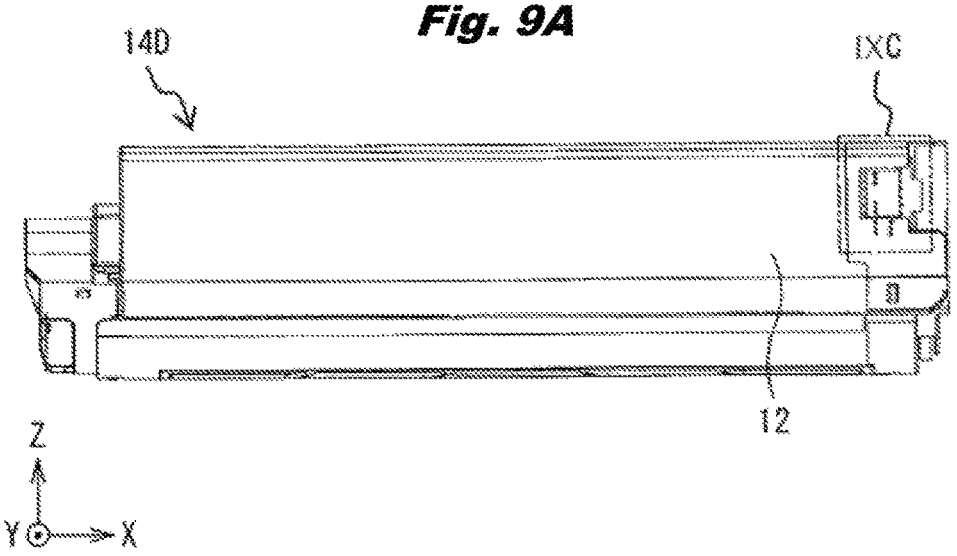
FIG. 9A is a side view showing an external appearance of the developer container as a fourth modified example.
Figure 9B:
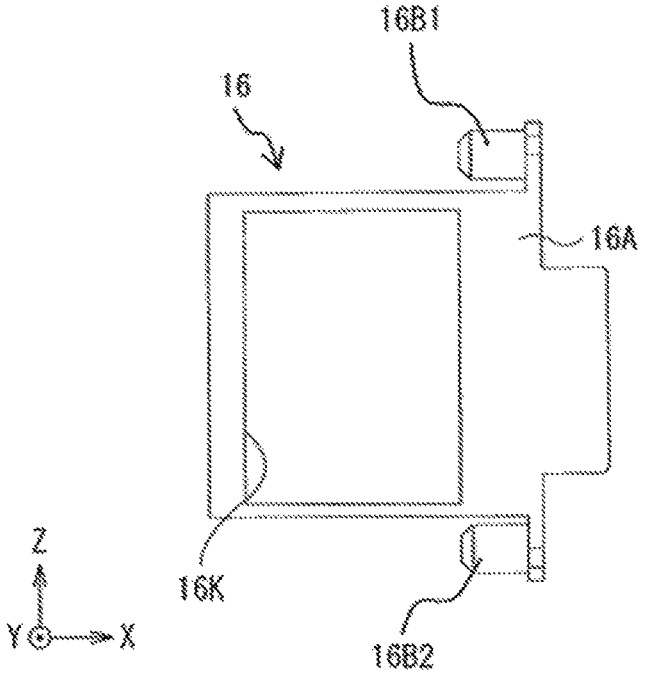
FIG. 9B is a plan view showing a holding member shown in FIG. 9A.
Figure 9C:
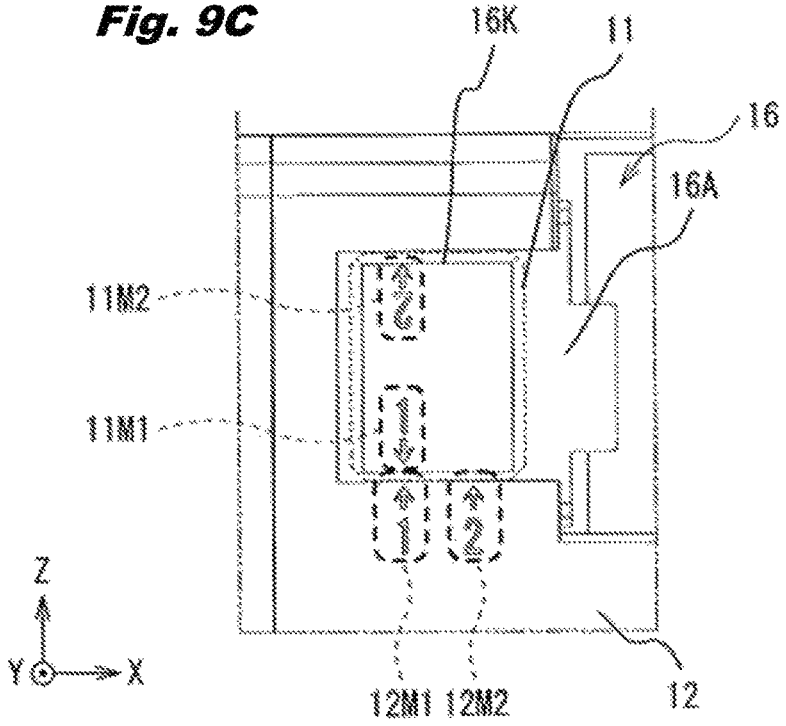
FIG. 9C is a main part enlarged side view showing a main part of the developer container shown in FIG. 9A in an enlarged manner.
Figure 9D:
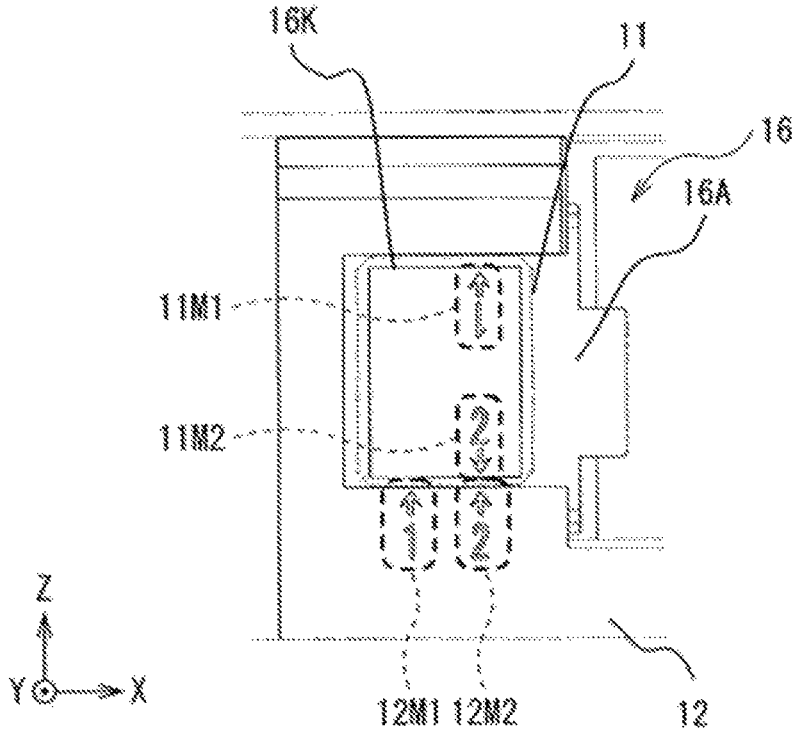
FIG. 9D is another main part enlarged side view showing the main part of the developer container shown in FIG. 9A in an enlarged manner.

FIG. 9A shows a toner cartridge 14D as a fourth modified example (Modified Example 4) of the present invention. FIG. 9A is a side view showing the external appearance of the toner cartridge 14D. FIG. 9B is a plan view showing the external appearance of a cover 16 used for the toner cartridge 14D shown in FIG. 9A. Further, FIGS. 9C and 9D are enlarged side views each showing the region IXC surrounded by the two-dotted chain line in the toner cartridge 14D shown in FIG. 9A. This Modified Example has substantially the same configuration as the toner cartridge 14A of Modified Example 1 except that a cover 16 is mounted instead of the cover 13. The cover 16 includes a plate part 16A made of an opaque material and an opening 16K provided near the center of the plate part 16A. The cover 16 is further provided with posts 16B1 and 16B2 to be inserted in the holes 12B1 and 12B2, respectively. FIGS. 9A, 9C, and 9D show a state in which the memory device 11 is correctly attached to the frame 12 and held by the cover 16. In this state, both the marker 11M and the marker 12M can be visually recognized from the outside with respect to the frame 12. This is because the opening 16K is formed in a part of the plate part 16A of the cover 16 overlapping with the markers 11M1 and 11M2 of the memory device 11. Therefore, also in this Modified Example, the same effects as those of the toner cartridge 14A of Modified Example 1 can be obtained. It should be noted that the shape of the opening 16K is not limited to that shown in FIG. 9B or the like.

Modified Example 5

Figure 10A:
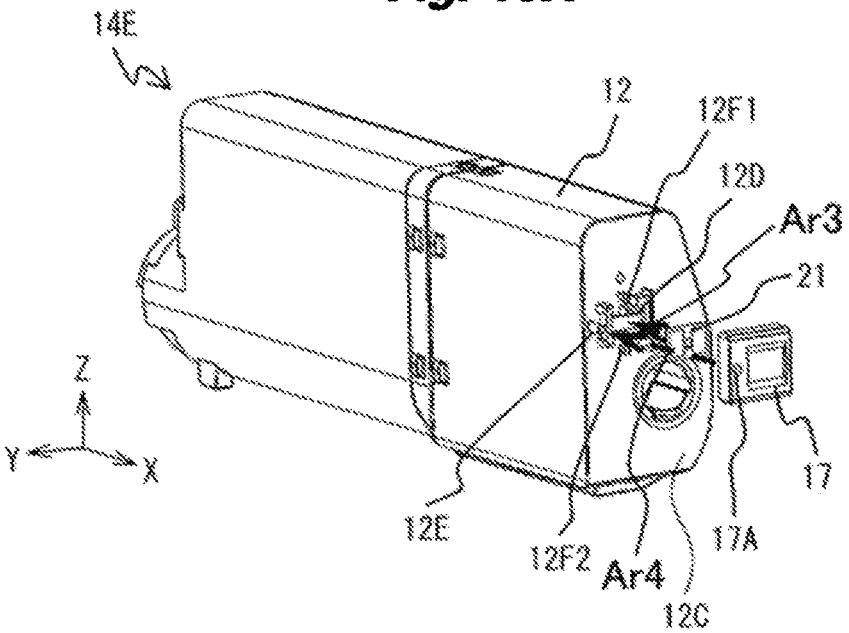
FIG. 10A is an exploded perspective view showing an external appearance of the developer container as a fifth modified example.
Figure 10B:
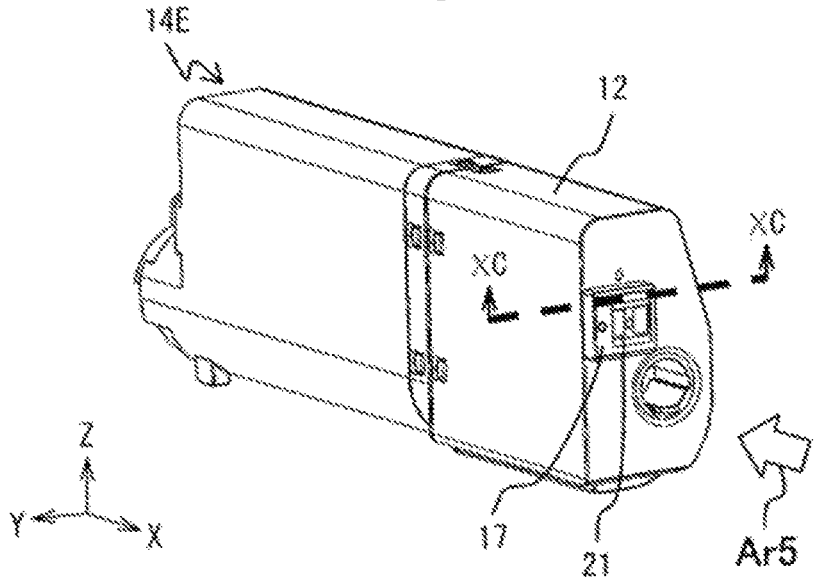
FIG. 10B is a perspective view showing an external appearance of the developer container as a fifth modified example.
Figure 10C:
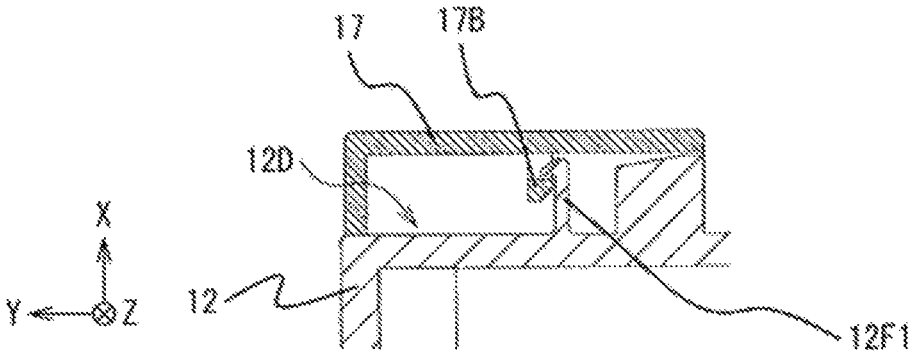
FIG. 10C is a main part enlarged side view showing the main part of the developer container shown in FIG. 10A in an enlarged manner.
Figure 10D:
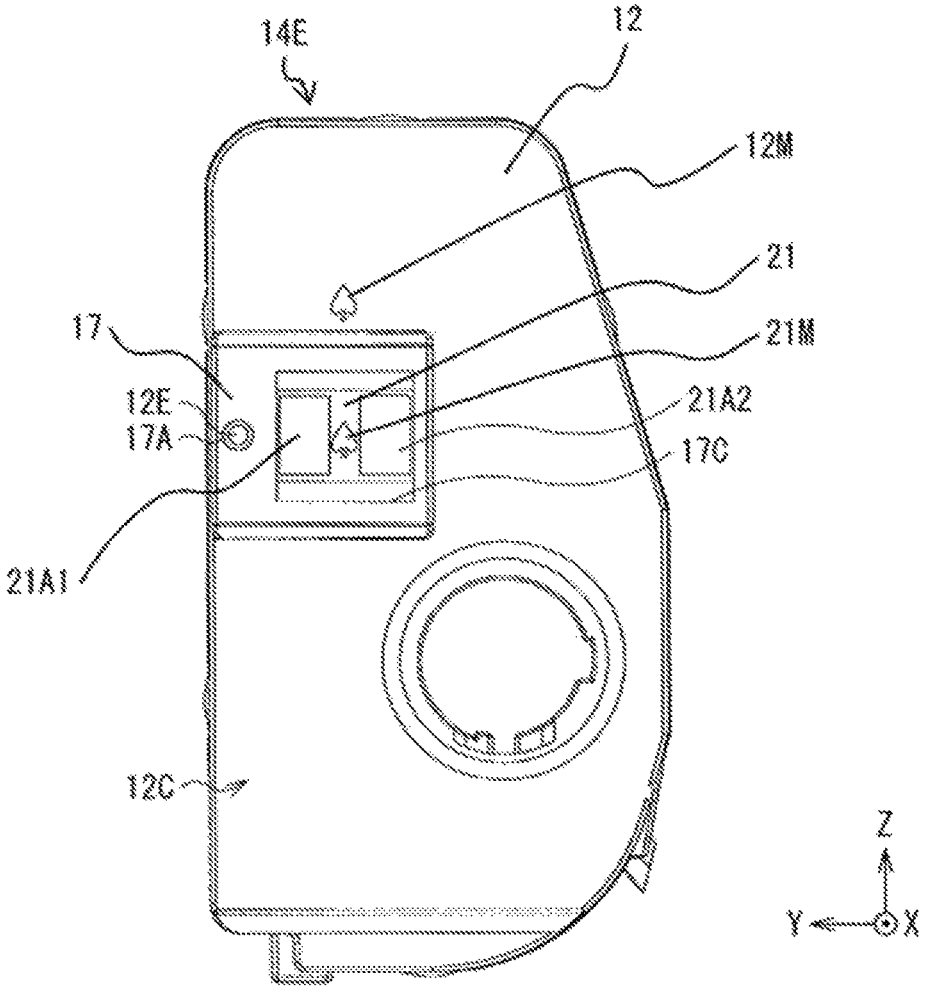
FIG. 10D is a front view showing an external appearance of the developer container as shown in FIG. 10A.

FIGS. 10A to 10D show a toner cartridge 14E as a fifth modified example (Modified Example 5) of the present invention. In the toner cartridge 14E of this Modified Example, a memory device 21 and a cover 17 are attached to a frame 12. FIGS. 10A and 10B are each a perspective view showing the external appearance of the toner cartridge 14E. Note that FIG. 10A is an exploded perspective view showing a stage before the memory device 21 and the cover 17 are attached to the frame 12. On the other hand, FIG. 10B shows a state in which the memory device 21 and the cover 17 are attached to the frame 12. FIG. 10C is a main part cross-sectional view showing a part of the cross-section taken along the line XC-XC shown in FIG. 10B. FIG. 10D is a front view of the external appearance of the toner cartridge 14E as viewed in the −X direction. FIGS. 10C and 10D each show a state in which the memory device 21 and the cover 17 are attached to the frame 12 similarly to FIG. 10B.

In this Modified Example, an accommodation part 12D configured to accommodate the memory device 21 is provided on the front face 12C of the frame 12. On the front face 12C, a post 12E projecting in the +X direction and clicks 12F1 and 12F2 are provided in an outwardly protruded manner. Further, a marker 12M is provided on the front face 12C.

Figure 11A:
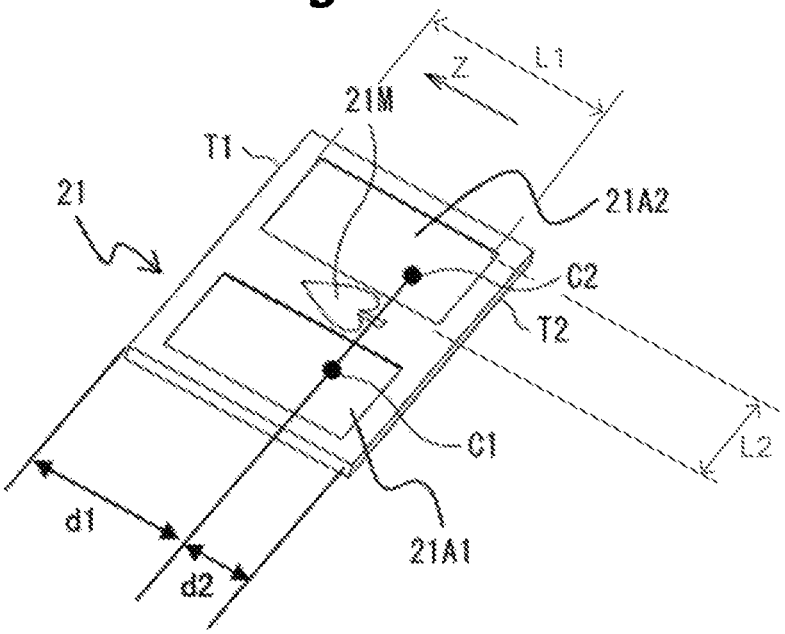
FIG. 11A is a perspective view showing an external appearance of a memory device to be attached to the developer container shown in FIG. 10A.
Figure 11B:
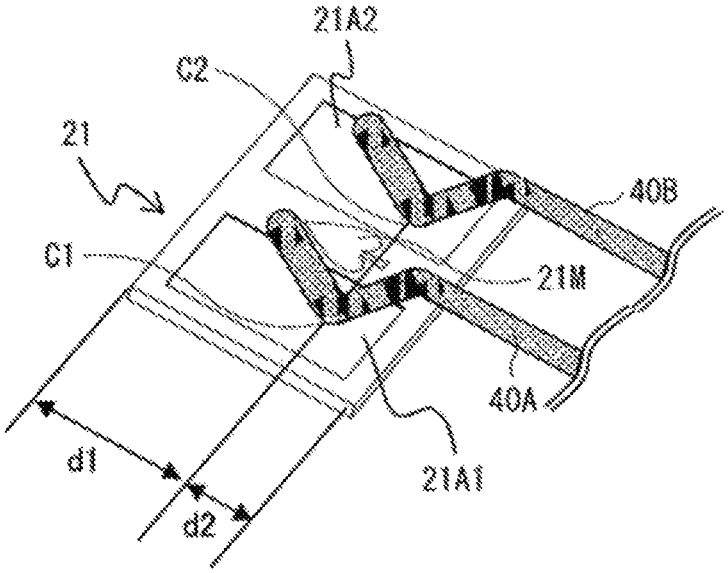
FIG. 11B is a perspective view showing one example of a use state of the memory device shown in FIG. 11A.

FIGS. 11A and 11B show the memory device 21 in an enlarged manner. FIG. 11A is a perspective view representing the external appearance of the memory device 21, and FIG. 11B is a perspective view showing the external appearance of the memory device 21 in a state in which it is communicable with an external device. The memory device 21 is a contact type ROM having, e.g., a memory element and external terminals 21A1 and 21A2 connected to the memory element, and has a flat external appearance. The memory device 21 is provided with a marker 21M. The external terminals 21A1 and 21A2 are configured to come into contact with external connection terminals 40A and 40B at contact points C1 and C2, respectively. The connection terminals 40A and 40B are connected to, for example, a communication part 71 of a control part 7, so that data is exchanged between the memory device 21 and the communication part 71 of the control part 7. The external terminals 21A1 and 21A2 correspond to one specific example of the "terminal" of the present invention, and the connection terminals 40A and 40B correspond to one specific example of the "contact member" of the present invention. Further, the memory device 21 has an end edge T1 and an end edge T2 opposed to each other in the alignment direction (here, the Z-axis direction) between the marker 12M and the marker 21M when the memory device 21 is attached to the frame 12. Note that the end edges T1 and T2 correspond to one specific example of "first end edge" and "second end edge" of the present invention, respectively. Here, the distance d1 from the contact points C1 and C2 to the end edge T1 is different from the distance d2 from the contact points C1 and C2 to the end edge T2. In FIGS. 11A and 11B, the distance d1 is larger than the distance d2, but the magnitude relation may be opposite.

In the embodiment, the ratio of d1/d2 is preferably ranged from 10/9 to 8/1. Further, when d1/d2 is around 6/3, it is more preferred. Regarding locations of the contact points C1 and C2, it is preferred that these contact points C1 and C2 are arranged at any position where is away from the end edges T1 and T2 by 5% margin of length L1 in the Z-axis direction. In other words, 90% of the middle section of length L1 suits for the contact points. In the same fashion, it is preferred that these contact points C1 and C2 are arranged at any position where is away from the other edges, which are perpendicular to end edges T1 and T2, by 5% margin of length L2 in an direction perpendicular to the Z-axis direction. In other words, 90% of the middle section of length L2 suits for the contact points.

The cover 17 is configured to be attached to the frame 12 so as to cover the memory device 21 accommodated in the accommodation part 12D and functions as a holding member for holding the memory device 21 in the accommodation part 12D. The cover 17 is provided with a hole 17A, a click 17B, and an opening 17C. When attaching the cover 17 to the frame 12 by moving in the −X direction with respect to the frame 12, the post 12E is configured to be inserted in the hole 17A and the click 17B is configured to be engaged with the clicks 12F1 and 12F2. The opening 17C is provided at a position overlapping the external terminals 21A1 and 21A2 and the marker 21M of the memory device 21 accommodated in the accommodation part 12D.

In such a toner cartridge 14E, the memory device 21 and the cover 17 are mounted to the frame 12 as follows. First, as shown in FIG. 10A, the memory device 21 is moved in the −X direction so as to be accommodated in the accommodation part 12D of the frame 12. Next, the cover 17 is moved in the −X direction, so that the cover 17 is attached to the frame 12 so as to sandwich the memory device 21 with the frame 12. Specifically, the post 12E is inserted in the hole 17A and the click 17B is engaged with the clicks 12F1 and 12F2 as shown in FIG. 10C. When it becomes a state in which the post 12E is inserted in the hole 17A, the cover 17 does not move within the Y-Z plane. Furthermore, with the engagement between click 17B and clicks 12F1 and 12F2, the cover 17 is prevented from being pulled out in the +X direction. Therefore, the cover 17 becomes a state of being fixed to the frame 12. As a result, the memory device 21 sandwiched therebetween is also fixed. In such an attached state, the external terminals 21A1 and 21A2 of the memory device 21 can make contact with the external connection terminals 40A and 40B via the opening 17C. In addition, the marker 21M can be visually recognized from the outside via the opening 17C, which enables an easy comparison with the marker 12M attached to the frame 12. In this Modified Example, the marker 21M and the marker 12M are asymmetry in shape in the Z-axis direction which is the arrangement direction of them. Therefore, by associating the state in which the orientation of the marker 21M coincides with the direction of the marker 12M with the case in which the toner cartridge 14E is an initial product, and also associating the state in which the direction of marker 21M and the direction of marker 12M are opposite to the case in which the toner cartridge 14E is a reused product, it may be configured so that both the cases can be easily distinguished by a user. In this case, since the distance d1 is set to be different from the distance d2, the contact points C1 and C2 at the external terminals 21A1 and 21A2 become relatively different positions depending on the orientation of the memory device 21 with respect to the frame 12, wear of the external terminals 21A1 and 21A2 can be reduced.

Modified Example 6

Figure 12A:
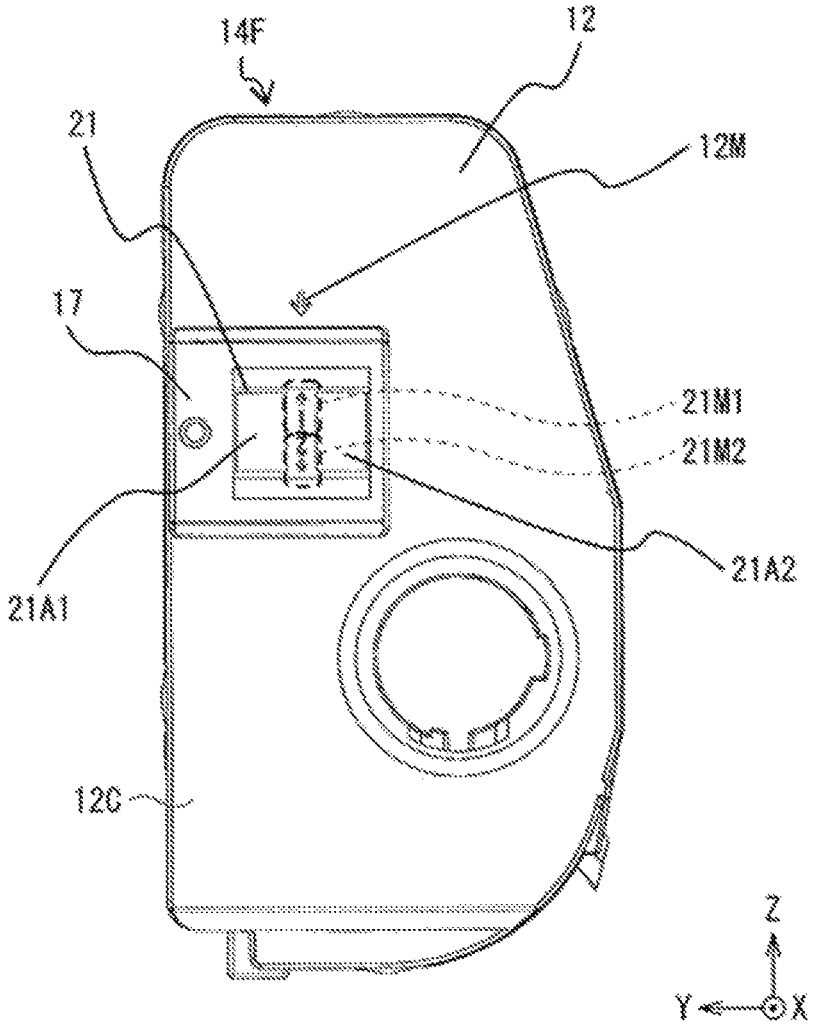
FIG. 12A is a front view showing an external appearance of a developer container as a sixth modified example.
Figure 12B:
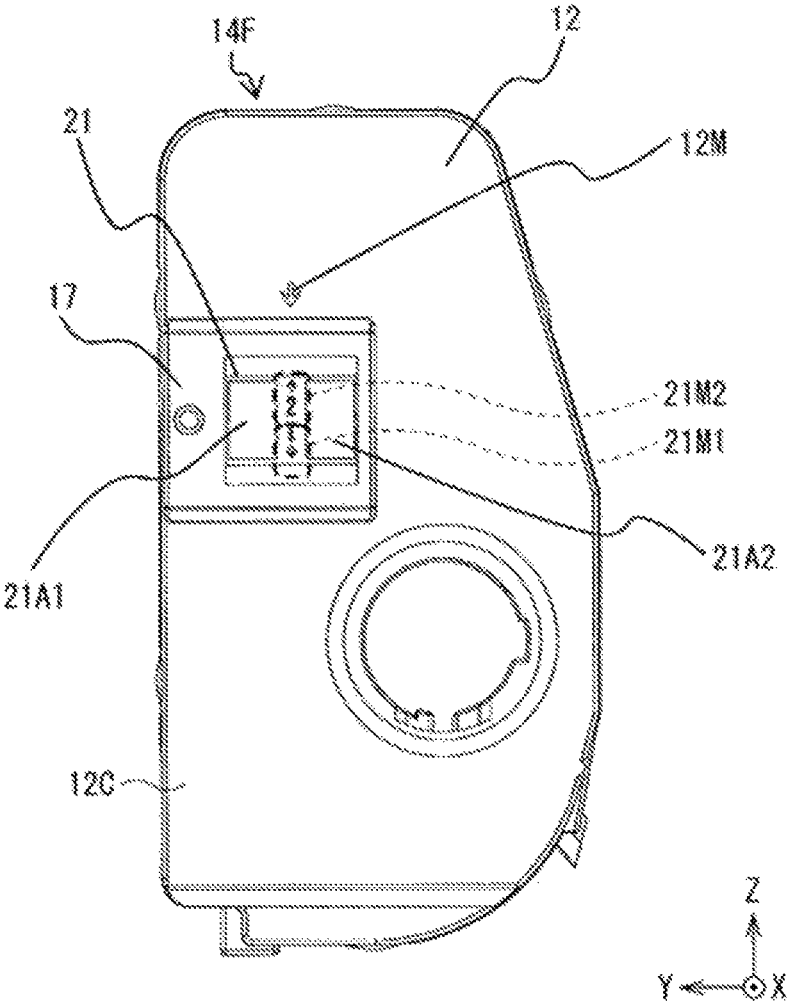
FIG. 12B is a front view showing an external appearance of the developer container as a sixth modified example.

FIG. 12A and FIG. 12B show a toner cartridge 14F as a sixth Modified Example (Modified Example 6) of the present invention. FIG. 12A and FIG. 12B are front views showing the external appearance of the toner cartridge 14F. However, the direction of the vertical direction (Z-axis direction) of the memory device 21 in FIG. 12A is opposite to the vertical direction (Z-axis direction) of the vertical direction of the memory device 21 in FIG. 12B. The toner cartridge 14F of this Modified Example has substantially the same configuration as the toner cartridge 14E of the aforementioned Modified Example 5 except that two markers 21M1 and 21M2 are provided instead of the marker 21M.

In FIG. 12A, the marker 21M1 consisting of the number "1" and the upward arrow "↑" is in a state of facing the marker 12M consisting of the downward arrow "↓" in the Z-axis direction. In this case, for example, it is possible to associate the case in which the toner cartridge 14F with an initial product. On the other hand, in FIG. 12B, the marker 21M2 consisting of the number "2" and the upward arrow "↑" is in a state of facing the marker 12M consisting of the downward arrow "↓" in the Z-axis direction. This case can be associated with, for example, a case in which the toner cartridge 14F is a reused one.

Thus, according to this Modified Example, it is possible for a user to easily determine whether the toner cartridge 14F is an initial product or a reused product by the attachment direction of the memory device 21 with respect to the frame 12.

Modified Example 7

Figure 13:
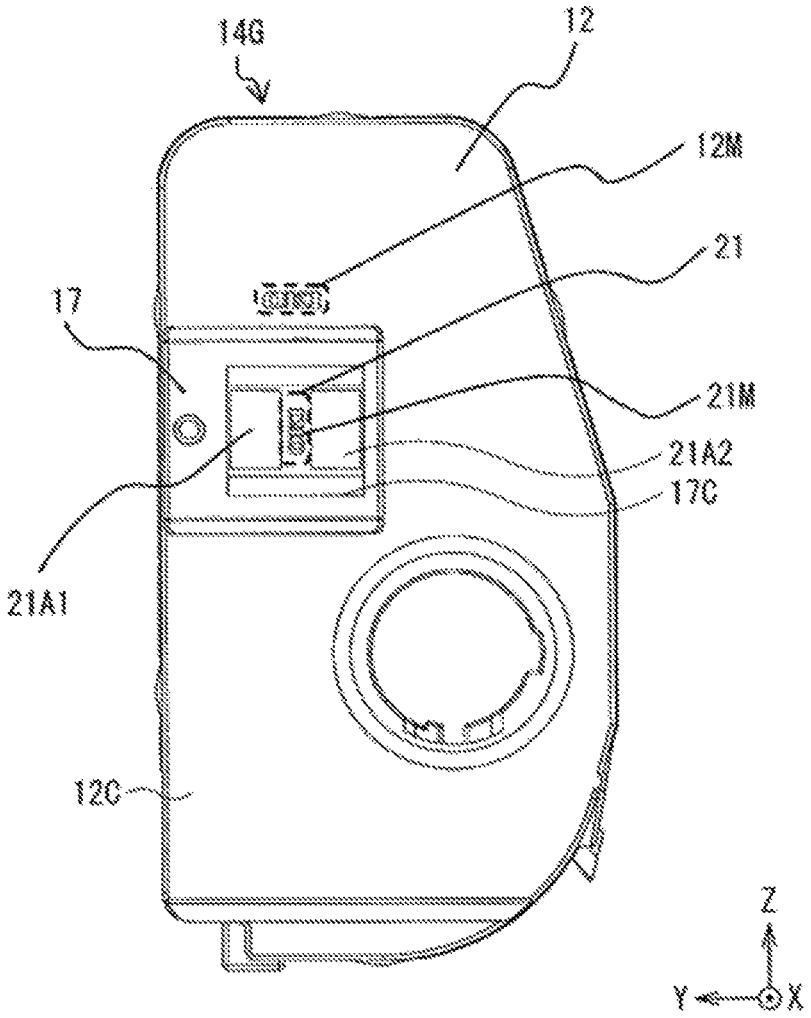
FIG. 13 is a front view showing an external appearance of the developer container as a seventh modified example.

FIG. 13 shows a toner cartridge 14G as a seventh modified Example (Modified Example 7) of the present invention. FIG. 13 is a front view showing the external appearance of the toner cartridge 14G. In this Modified Example, the memory device 21 is provided with a marker 21M consisting of a character string arranged in the Z-axis direction. The frame 12 is provided with a marker 12M which is aligned in the Y-axis direction and is the same character string as the marker 21M. Except for this point, the other configuration is substantially the same as those of the toner cartridge 14E of the aforementioned Modified Example 5.

In this Modified Example, it is easy for a user to visually recognize that the character string of the marker 21M and the character string of the marker 12M are the same. Therefore, it can be easily confirmed that the memory device 21 is properly attached to the frame 12. Therefore, it is possible to effectively prevent any attachment error of the memory device 21 (non-attachment or erroneous attachment). The character strings of the markers 21M and 12M are not limited to those shown in FIG. 13. In FIG. 13, the alignment direction of the character string of the marker 21M is set in the Z-axis direction, but not limited thereto in this Modified Example. The alignment direction of the character string of the marker 21M may be in the Y-axis direction or another direction. Similarly, in FIG. 13, the alignment direction of the character string of the marker 12M is set in the Y-axis direction, but not limited thereto in this Modified Example. The alignment direction of the character string of the marker 12M may be in the Z-axis direction or another direction. Also, in FIG. 13, the case in which the alignment direction of the character string of the marker 21M and the arrangement direction of the character string of the marker 12M are set to be orthogonal is exemplified. However, both of them may be set in parallel each other, or both of them may be set so as to form an angle other than a right angle.

Modified Example 8

Figure 14A:
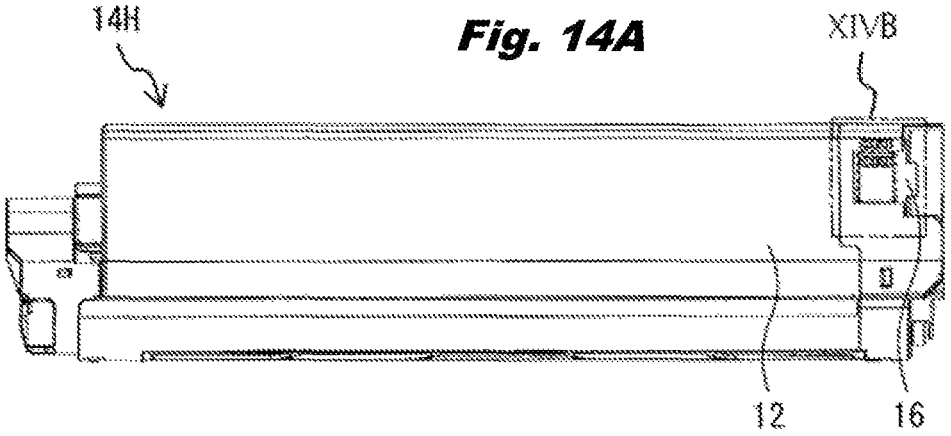
FIG. 14A is a side view showing an external appearance of the developer container as an eighth modified example.
Figure 14B:
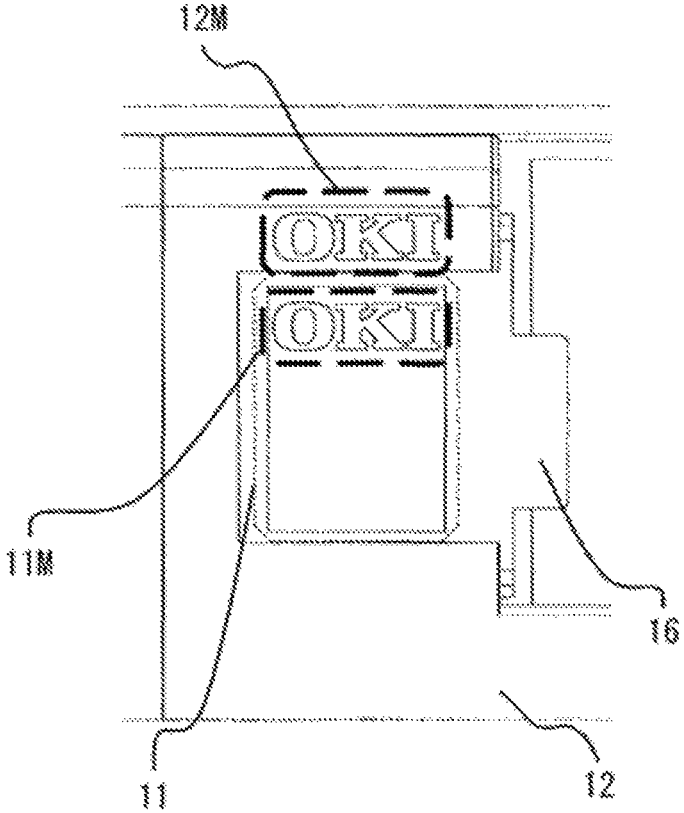
FIG. 14B is a main part enlarged side view showing the main part of the developer container shown in FIG. 14A in an enlarged manner.

FIG. 14A shows a toner cartridge 14H as an eighth modified Example (modified Example 8) of the present invention. FIG. 14A is a side view showing the external appearance of the toner cartridge 14H. FIG. 14B is an enlarged side view showing the region XIVB surrounded by the two-dotted chain line in the toner cartridge 14H shown in FIG. 14A. The modified Example has substantially the same configuration as the toner cartridge 14D of the modified Example 4 except that it has markers 11M and 12M consisting of character strings.

In this Modified Example, a user can easily recognize that the character string of the marker 11M and the character string of the marker 12M match. Therefore, it can be easily confirmed that the memory device 11 is properly attached to the frame 12. Therefore, it is possible to effectively prevent the attachment error (un-attachment or erroneous attachment) of the memory device 11. The character strings of the markers 11M and 12M are not limited to those shown in FIGS. 14A and 14B.

In the first embodiment, although the marker 12M as the "second marker" of the present invention is attached to the frame 12 as the "accommodation member" of the present invention, the present invention is not limited thereto. For example, the "second marker" of the present invention may be provided to the "holding member" (for example, the flat plate part 13A of the cover 13) of the present invention. In either case, it is sufficient that both the first marker and the second marker are configured to be visually recognized.

Further, the series of processes described in the aforementioned embodiments, etc., may be performed by a hardware (circuit) or a software (program). When it is configured to be performed by a software, the software is configured by a group of programs for making each function execute by a computer. For example, each program may be used by being installed in a computer in advance, or may be installed in the computer from a network or a recoding medium.

In the aforementioned embodiment, etc., although an LED head having a light source is used as the exposure device, an exposure device with a light element, etc., as a light source may be used, for example.

Further, in the aforementioned embodiment, etc., an image forming apparatus having a print function is explained as one specific example of the "image forming apparatus" in the present invention, but the present invention is not limited to this. That is, in addition to such a print function, the present invention can also be applied to an image forming apparatus functioning as a multifunction machine having, e.g., a scanning function and a facsimile function.

Further, in the aforementioned embodiment, etc., among "development units", although an image forming apparatus in which a memory device and a holding member are attached to a frame of a toner cartridge is exemplified, the present invention is not limited to this. Further, in the aforementioned embodiment, etc., among "development units", although an image forming apparatus in which a memory device and a holding member are attached to a frame of a toner cartridge is exemplified, the present invention is not limited to this. Alternatively, a memory device and a holding member may be attached to the "image carrier unit" instead of the "development unit". In that case, for example, it is sufficient to provide an accommodation part for attaching the memory device 11 and the cover 13 to the housing 31. Further, a memory device and a holding member may be attached to both the "development unit" and the "image carrier unit", respectively.

In the above embodiments, the memory devices are in rectangular shapes. However, the invention is not limited to such a shape. The device may be a pentagon, a hexagon, an octagon and more polygonal shape. When the memory device has a polygonal shape which has more than four sides, variety of inserting directions can be realized so that more information can be visually recognized. When the memory device is in a circular shape, the insertion direction can be 360 degrees. Further, the container was modified to read out of the both sides (or front and back sides) of the memory device, the information that the memory device provides can be double.

What is claimed is:

1. A developer container, comprising:

a memory device with a first marker; and a main body configured to accommodate a developer, wherein, the main body is configured with an accommodation member, a second marker and a holding member that is formed on an outer surface of the accommodation member, the accommodation member being configured to accommodate the developer, the second marker being placed on the outer surface of the accommodation member, the holding member being formed in a recess portion to hold the memory device such that the memory device is held with respect to the accommodation member, and the memory device is attached to the main body such that both the first marker and the second marker are visually recognized.

2. The developer container according to claim 1, wherein in a state where the memory device is held in the holding member, the first marker of the memory device and the second marker of accommodation member are positioned adjacent to each other.

3. The developer container according to claim 1, wherein a direction in which the memory device moves to be inserted into the recess portion of the holding member is defined as the first direction, and another direction that is orthogonal to the first direction and on a flat surface of the memory device is defined as the second direction, in a state where the memory device is fully inserted to the holding member, the first marker and the second marker are aligned in the second direction.

4. The developer container according to claim 3, wherein the memory device is configured with a memory element that stores data and a terminal that is positioned on the flat surface thereof and connects to the memory element to input the data to or output from the memory element, including first and second end edges that are arranged along the first direction in parallel and opposed in the second direction, the accommodation member includes a contact member, which comes into contact with the terminal at a contact point, a first distance is defined as a distance from the contact point to the first end edge in the second direction, and a second distance is defined as another distance from the contact point to the second end edge in the second direction, the first distance is not the same as the second distance.

5. The developer container according to claim 1, wherein the memory device is configured to be held in two or more different orientations with respect to the holding member.

6. The developer container according to claim 5, wherein a third marker is provided on the memory device, a fourth marker is provided on the accommodation member, when the memory device is held in one orientation such that the first marker and the second marker are positioned adjacent to each other, being defined as the first attachment state, and when the memory device is held in another orientation such that the third marker and the fourth marker are positioned adjacent to each other, being defined as the second attachment state.

7. The developer container according to claim 1, wherein the holding member includes a cover that covers the recess portion such that the memory device is placed between the cover and the recess portion when held, a portion of the cover being transparent and defined as a transparent portion, and in a state where the memory device is held in the holding member, the transparent portion and the first marker are overlapped.

8. The developer container according to claim 1, wherein the holding member includes a cover that covers the recess portion such that the memory device is placed between the cover and the recess portion when held, a portion of the cover being a cutout or an opening and defined as an opening portion, and in a state where the memory device is held in the holding member, the opening and the first marker are overlapped.

9. A development unit, comprising:

the developer container according to claim 1, and an image carrier that develops an latent image formed thereon using the developer supplied from the developer container.

10. An image forming unit, comprising:

the developer container according to claim 1; and an image forming part which performs an image formation using the developer supplied from the developer container.

11. An image forming apparatus, comprising:

a plurality of image forming units, each of the image forming units including the developer container according to claim 1 and an image forming part that performs an image formation using the developer supplied from the developer container.

12. An image carrier unit, comprising:

a memory device with a first marker;

a housing that is configured to accommodate an image carrier;

a holding member that is disposed in the housing and configured to hold the memory device with respect to the housing, wherein;

the housing is configured with an accommodation member in which the image carrier is accommodated and a second marker that is formed on an outer surface of the accommodation member, and the holding member is formed in a recess portion to hold the memory device, the recess portion being formed on the outer surface of the accommodation member, and both the first marker and the second marker are visually recognized.

13. An image forming unit equipped with the image carrier unit according to claim 12.

14. An image forming apparatus equipped with an image forming unit including the image carrier unit according to claim 12.

* * * * *